US007005150B2

(12) United States Patent
Kuge et al.

(10) Patent No.: US 7,005,150 B2
(45) Date of Patent: Feb. 28, 2006

(54) BEVERAGE CONTAINER

(75) Inventors: Raizo Kuge, Tokyo (JP); Toru Ichikawa, Tokyo (JP); Susumu Niwa, Tokyo (JP); Shuzo Adachi, Tokyo (JP)

(73) Assignees: Kabushiki Kaisha Hosokawa Yoko, Tokyo (JP); Flexo Manufacturing Corporation, Caloocan (PH)

( * ) Notice: Subject to any disclaimer, the term of this patent is extended or adjusted under 35 U.S.C. 154(b) by 254 days.

(21) Appl. No.: 10/204,229

(22) PCT Filed: May 30, 2001

(86) PCT No.: PCT/JP01/04560

§ 371 (c)(1),
(2), (4) Date: Aug. 19, 2002

(87) PCT Pub. No.: WO01/94235

PCT Pub. Date: Dec. 13, 2001

(65) Prior Publication Data

US 2003/0012851 A1 Jan. 16, 2003

(30) Foreign Application Priority Data

| | | |
|---|---|---|
| Jun. 2, 2000 | (JP) | P2000-165928 |
| Aug. 23, 2000 | (JP) | P2000-252996 |
| Aug. 23, 2000 | (JP) | P2000-252997 |
| Sep. 26, 2000 | (JP) | P2000-29300 |

(51) Int. Cl.
*B65D 83/00* (2006.01)

(52) U.S. Cl. ..... 426/85; 426/87; 426/115; 426/122; 426/123; 383/208; 383/209; 383/104; 383/106; 383/120; 383/906

(58) Field of Classification Search ..... 426/85, 426/87, 112, 115, 122, 123, 127; 383/200–209, 383/104, 106, 120, 906; 229/103.1
See application file for complete search history.

(56) References Cited

U.S. PATENT DOCUMENTS

| | | | | |
|---|---|---|---|---|
| 2,992,118 A | * | 7/1961 | Daline | 426/85 |
| 3,074,612 A | * | 1/1963 | Schneider | 426/85 |
| 3,106,312 A | * | 10/1963 | Hitchcock | 220/709 |
| 3,134,680 A | * | 5/1964 | Daline | 426/85 |
| 3,751,581 A | * | 8/1973 | Sakata et al. | 348/444 |
| 3,799,914 A | | 3/1974 | Schmit et al. | |

(Continued)

FOREIGN PATENT DOCUMENTS

EP 0 893 358 A1 1/1999

(Continued)

*Primary Examiner*—Drew Becker
(74) *Attorney, Agent, or Firm*—Sughrue Mion, PLLC

(57) ABSTRACT

A beverage container configured from a front and a rear surface portion, a base portion, and a pair of gusset portions. The gusset portions configure side portions of the container by being sealed to mutually confronting edge portions of the front and rear surface portions and the base portion. The upper portions of the front and rear surface portions configure a neck portion that has a more slender shape than the remainder of the front and rear surface portions and that extends in a single direction. A notch is formed in the edge sealed portion of the neck portion. The front and rear surface portions are sealed directly together at a predetermined region corresponding to the notch without the gusset portions existing therebetween. A straw extends from and is positioned within the neck portion. The neck portion can be opened from the notch.

19 Claims, 20 Drawing Sheets

U.S. PATENT DOCUMENTS

| | | | | | |
|---|---|---|---|---|---|
| 4,411,359 | A | * | 10/1983 | Franco | 206/217 |
| 5,085,335 | A | * | 2/1992 | Carbaugh | 220/709 |
| 5,564,591 | A | | 10/1996 | Christine et al. | |
| 5,884,758 | A | * | 3/1999 | Sigouin et al. | 206/217 |
| 5,937,617 | A | * | 8/1999 | Yeager | 53/412 |
| 6,126,315 | A | | 10/2000 | Ichikawa et al. | |
| 6,375,001 | B1 | * | 4/2002 | Beach | 206/217 |
| 6,375,002 | B1 | * | 4/2002 | Edwards | 206/217 |
| 6,854,490 | B1 | * | 2/2005 | Murray | 141/10 |

FOREIGN PATENT DOCUMENTS

| | | | |
|---|---|---|---|
| EP | 0 997 392 | A1 | 5/2000 |
| FR | 1 120 327 | A | 7/1956 |
| JP | 63-107968 | | 7/1998 |
| TW | 338419 | | 8/1998 |
| TW | 358790 | | 5/1999 |
| WO | WO 95/11176 | A1 | 4/1995 |
| WO | WO 99/02426 | A1 | 1/1999 |

* cited by examiner (a)

(b)

BEVERAGE CONTAINER

TECHNICAL FIELD

The present invention relates to a beverage container, and more particularly, to a beverage container that encloses a beverage and a straw.

BACKGROUND ART

Containers made from flexible resin have been widely used as beverage containers. With this type of beverage container, an upper portion of the container is cut to form a pouring spout. When a straw is inserted in the pouring spout, the beverage within the container can be sipped through the straw. However, with such a configuration, the beverage container is not very convenient because the user must go to the trouble of inserting the straw and also because the straw must be provided in addition to the container.

There has been proposed a straw-enclosed type beverage container 1200 as shown in FIG. 22. The beverage container 1200 has a quadrangular main body portion 1202 that is heat sealed along four sides to hold a beverage. The main body portion 1202 is configured from a front surface portion 1205, a rear surface portion 1206, and a base gusset portion 1203. The rear surface portion 1206 has the same shape as the front surface portion 1205. The base gusset portion 1203 configures the base that connects the front surface portion 1205 and the rear surface portion 1206. The base gusset portion 1203 is formed with an inward fold along a fold portion 1203*a*. The fold has a V-shape when viewed in cross-section. The base gusset portion 1203 is fused to the front surface portion 1205 and the rear surface portion 1206 by a heat seal. A slender-opening neck portion 1209 is formed at one end of the upper-most portion of the main body portion 1202. The neck portion 1209 is formed by changing the width of the heat seal and forms a pouring spout when cut. A straw for sipping the beverage is disposed in the main body portion 1202.

The beverage container 1200 has a flat shape overall. Therefore, the surface area of the front surface portion 1205 and the rear surface side 1206 must be increased to increase the amount of beverage that can fill the container. When a consumer opens this type of beverage container 1200 at the neck portion 1209, normally the consumer grasps the heat-sealed portion near the neck portion with fingers of both hands and tears across the neck portion 1209 in one of the directions indicated by arrows A. For example, by pulling his or her right hand to this side of the sheet of FIG. 22, and his or her left hand to the far side of the sheet of FIG. 22, the container will twist and tear in one of the arrow directions A. However, it is difficult to tear using this opening method. A bit of chance is involved in whether the tear will fall reliably across the neck portion. That is, if the paths that the opening follows in the front surface portion 1205 side and in the rear surface portion 1206 side are greatly shifted from each other, the tearing locus cannot be sufficiently across the neck portion. If, rather than going across the neck portion, the opening paths shift to upward in the drawing, then the container will open insufficiently. If the opening paths shift downward, then the beverage will leak out undesirably.

There is also the disadvantage in that if the upper portion of the straw 1213 is located in the neck portion 1209 while the container is being opened, then when the neck portion is torn in the above-described manner the tearing operation will be stopped because the tear track will hit the upper portion of the straw.

Further, if the tip of the straw catches on the inner wall of the rear surface portion or the front surface portion, so that the straw sinks into the beverage, then the straw, which is inside the beverage container, must be drawn out to protrude from the opening after the neck portion is torn open. If the user's fingertips are dirty, then dirty fingertips will contact the opening, which is undesirable from a sanitation point of view.

The beverage can be sipped through the straw as long as the neck portion is completely torn, without completely separating the unneeded heat sealed portion of the torn upper portion from the container. However, the unneeded heat sealed portion of the torn upper portion can brush up against the consumer's face and the like while he or she is sipping the beverage and produce an unpleasant sensation.

The neck portion 1209 can be opened at a desired position using scissors and the like. However, when the beverage container 1200 is to be carried outside and opened there, the consumer must take along a pair of scissors, which is troublesome. Further, when opening the neck portion 1209 using a pair of scissors and the like, then the consumer must cut the upper surface portion 1205 and the rear surface portion 1206 of the neck portion 1209 while avoiding cutting the straw if the upper portion of the straw 1213 is positioned within the neck portion 1209. In some cases, the consumer can accidentally cut the entire upper portion of the straw 1213 in the neck portion 1209 with the scissors.

It is an object of the present invention to provide a beverage container with a straw disposed inside, wherein the beverage container can be opened at the opening position using the tearing force of finger tips, without using a tool such as a pair of scissors, and wherein the upper portion of the straw will not obstruct the opening process.

DISCLOSURE OF INVENTION

A beverage container according to the present invention includes a main body portion and a drinking straw, the main body portion holding a beverage, the drinking straw being sealed in the main body portion with the beverage, the improvement characterized by the main body portion being configured from a front surface portion, a rear surface portion having the same shape as the front surface portion, a bottom portion, and a pair of gusset portions, the gusset portions configuring side portions of the main body portion and heat-sealed to edge portions of the front surface portion, the rear surface portion, and the bottom portion, the gusset portions each having a V-shape in cross-section to provide a bent portion before beverage is sealed in the container, deformation of the gusset portions moving the front surface portion and the rear surface portion away from each other so that the beverage can be filled into the main body portion, the front surface portion and the rear surface portion having upper portions configuring a neck portion formed in a shape more slender than a remainder of the front surface portion and the rear surface portion, the neck portion extending in a direction, the straw extending in the direction from the bottom portion toward the neck portion, the straw having an upper portion capable of being disposed within the neck portion, a notch for starting a tear being formed on an edge portion of a heat seal portion in the neck portion to serve as a tear position instruction portion indicating a tear position, the front surface portion and the rear surface portion being heat sealed directly together without existence of the gusset portions at least at a predetermined region corresponding to the notch, and a tear direction instruction portion being provided on least one of the front surface portion, the rear surface portion, and the gusset portions, the tear direction instruction portion instructing consumers to grasp both sides of the notch and to pull in the direction and opposite the direction to make a tear, the neck portion being capable of being opened from the notch and over the upper portion of the straw.

A beverage container with this configuration is provided with a tear direction instruction portion. Therefore, the tear starts at the deepest portion of the notch when, based on this instruction, either side of the notch is pulled in opposite directions along the same straight light and also following the direction from the neck portion toward the base portion. Also, force is always concentrated on the lead end of the tear in the same manner that the force acting on the front surface portion and the rear surface portion is concentrated on the deepest portion of the notch. Even when the path of the tear reaches the heat seal portion at the side opposite from where the notch is formed, the tear can be easily continued also at the heat seal portion on the opposite side. The tear can be performed reliably across the neck portion so that the entire heat seal portion at the upper neck portion can be removed.

Also, even if the tear paths in the front surface portion and the rear surface portion are slightly shifted from each other, the tear can be easily continued in the heat seal portion in the front surface portion at the side opposite from the notch and in the heat seal portion in the rear surface portion at the opposite side from the notch because the force acting on the front surface portion and the rear surface portion is always concentrated on the lead of the tear path as described above. Accordingly, the heat seal at the upper neck portion can be completely removed. As a result, the heat seal portion at the upper neck portion will not brush up against the consumer's face when the consumer is sipping the beverage.

Further, the tearing force is applied in a direction that does not interfere with the upper portion of the straw. Therefore, the straw does not get in the way during tearing.

Further, the gusset portions do not exist at positions where the tear occurs, but only the front surface portion and the rear surface portion exist at the positions where the tear is formed. Therefore, less force is required for the tear than if the gusset portions were located where the tear is formed.

Further, the side portion of the beverage container is configured from the gusset portions, except for a particular portion. Therefore, a larger amount of beverage can be contained in the container. Also, the beverage container has a stable three-dimensional shape, so the beverage container can stand up by itself if needed.

Preferably, the upper portion of the front surface portion and the upper portion of the rear surface portion of the main body portion are in a more slender shape than the remainder of the front surface portion and the rear surface portion to constitute the neck portion extending in a vertical direction, the entire slender portion being the predetermined region where confronting edge portions are directly heat sealed together without the gusset portions being interposed therebetween, a distance between the edge portions of the neck portion being the same or smaller than a distance between bent lines of the bent portion of the gusset portions. A beverage container with this configuration has no gusset portion across the entire side of the neck portion. Therefore, the beverage container is easier to make than if the gusset portion were not present at only a predetermined region of the neck portion.

Further, preferably, the tear direction instruction portion is configured by directly printing the tear direction on one of the front surface portion, the rear surface portion, and the gusset portions. Because the tear direction instruction portion is configured by printing, the direct tearing direction at a position on one of the front surface portion, the rear surface portion, or the gusset portions, the tear direction instruction portion is easier to provide.

Alternatively, the tear direction instruction portion comprises a label or a seal that indicates the tear direction, the label or seal being attached or stuck on the one of the front surface portion, the rear surface portion, and the gusset portions. With this configuration, the instruction portion can be provided in a separate operation after the container has been produced.

Further, preferably, the front surface portion and the rear surface portion are made from laminate sheets, at least one of the front surface portion and the rear surface portion being formed with perforations formed through all but at least one layer of the laminate sheet across the entire width of the neck portion at a position corresponding to the notch. By forming the perforations, the tearing strength of the laminate sheet is reduced at the locations of the perforations. Therefore, the consumer can easily open the neck portion of the container by using his or her fingers to tear along the perforations from the notch and over the upper portion of the straw. Also, leaks from the beverage container can be prevented because the perforations are covered up and do not penetrate through the front surface portion and the rear surface portion.

Further, preferably, the straw is immovably fixed to the neck portion or near the neck portion. Because the straw is immovably fixed to the neck portion or near the neck portion, the trouble of drawing the straw from out of the container after the container is opened can be eliminated. Also, when the front surface portion and the rear surface portion are formed from a flexible material, the straw acts as a reinforcing member near the neck portion and is positioned where the consumer's fingers suppress the straw during tearing. Therefore, the beverage container is easier to grasp and even easier to tear.

In this case, preferably, a region of the predetermined region that corresponds to the notch and where the front surface portion and the rear surface portion are directly heat sealed together extends to outer peripheral surface of the upper portion of the straw positioned within the neck portion in order to support the straw in a position with respect to the main body portion. With this configuration, the straw can be easily supported during the heat seal process of the beverage container.

Alternatively, an upper portion of the straw positioned within the neck portion is thermally sealed to at least one of the front surface portion and the rear surface portion at a position lower than the notch portion in order to support the straw in a position with respect to the main body portion. The heat seal can be executed by a simple method, such as point sealing. The straw can be easily fixed to the main body portion.

Further, preferably, the straw is provided with a protrusion portion engageable with the inner periphery of the neck portion in order to prevent the straw from being pulled out from the main body portion. Accordingly, the protrusion portion of the straw will engage with the inner peripheral surface of the neck portion even if the straw separates from the main body portion and the straw is made from a material with low specific gravity. Therefore, the straw can be prevented from floating up excessively or being pulled out.

Further, preferably, the bent portions of the pair of gusset portions are, in the condition before being filled with beverage, positioned mutually symmetrical with respect to and in parallel with a lengthwise center line of the main body portion, the straw being supported between the bent portions. Because the bent portions of the gusset portions are positioned symmetrically and in parallel with respect to the lengthwise direction centerline of the main body portion, the straw is supported at a position between the bent portions. Accordingly, the straw is supported at the position of the lengthwise direction center portion and, moreover, at the thin portion of the main body portion where no gusset portion exists. This is convenient because the beverage container can be stacked up when carried, without becoming bulky.

Further, preferably, the front surface portion and the rear surface portion are configured from a transparent or opaque resin material. With this configuration, the consumer can visually confirm the position of the straw, and also grasp the amount of beverage, from outside the container.

In another aspect of the invention, there is provided a beverage container having a main body portion and a drinking straw, the main body portion holding a beverage, the drinking straw being sealed in the main body portion with the beverage, the improvement comprising: the main body portion being configured from a front surface portion, a rear surface portion having the same shape as the front surface portion, a bottom portion, and a pair of gusset portions, the gusset portions configuring side portions of the main body portion and heat-sealed to edge portions of the front surface portion, the rear surface portion, and the bottom portion, the gusset portions each having a V-shape in cross-section to provide a bent portion before beverage is sealed in the container, deformation of the gusset portions moving the front surface portion and the rear surface portion away from each other so that the beverage can be filled into the main body portion, an upper portion of the front surface portion and an upper portion of the rear surface portion of the main body portion constituting a neck portion formed in a shape more slender than a remainder of the front surface portion and the rear surface portion and extending in a vertical direction, the gusset portions also configuring a side portion of the neck portion, the neck portion functioning as an upper pouring spout by tear-opening the neck portion, an upper portion of the straw being positioned extending into the neck portion, a tear position instruction portion indicating a tear position on the neck being provided on an edge portion of a heat seal portion in the neck portion, the front surface portion and the rear surface portion being heat seal directly together without existence of the gusset portions only at a predetermined region corresponding to the tear position instruction portion, and the front surface portion and the rear surface portion being made from laminate sheets, at least one of the front surface portion and the rear surface portion being formed with perforations formed through all but at least one layer of the laminate sheet across the entire width of the neck portion at a position corresponding to the tear direction instruction portion, the neck portion being capable of being opened along the perforations and over the upper portion of the straw.

Because the tear position instruction portion, such as a notch, that indicates a tear position on the neck is provided on a heat sealed edge of the neck portion and because the front surface portion and the rear surface portion are heat sealed directly together without the gusset portions only at a predetermined region corresponding to the tear position instruction portion, the strength at the predetermined region corresponding to the tear position instruction portion is weaker so that it is easy to tear in order to open the container.

Because the front surface portion and the rear surface portion are made from a laminate sheet and because the perforations are formed at least one of the front surface portion and the rear surface portion and through all but at least one layer of the laminate sheet across the entire width of the neck portion at a position that corresponds to the tear direction instruction portion, the tearing strength of the laminate sheet is reduced at the perforation portion. The consumer can use his or her fingers to easily tear open the neck portion following the perforation portion from the tearing instruction portion to over the upper portion of the straw. Also, because the perforations are covered up, and do not penetrate through the front surface portion and the rear surface portion, leaks from the beverage container can be prevented.

In still another aspect of the invention, there is provided a beverage container having a main body portion and a drinking straw, the main body portion holding a beverage, the drinking straw being sealed in the main body portion with the beverage, and the improvement comprising: the main body portion being configured from a front surface portion, a rear surface portion having the same shape as the front surface portion, a bottom portion, and a pair of gusset portions, the gusset portions configuring side portions of the main body portion and heat-sealed to edge portions of the front surface portion, the rear surface portion, and the bottom portion, the gusset portions each having a V-shape in cross-section to provide a bent portion before beverage is sealed in the container, deformation of the gusset portions moving the front surface portion and the rear surface portion away from each other so that the beverage can be filled into the main body portion, an upper portion of the front surface portion and an upper portion of the rear surface portion of the main body portion including a neck portion formed in a shape more slender than a remainder of the front surface portion and the rear surface portion and extending in a vertical direction, confronting edges of the slender front surface portion and the slender rear surface portion being heat sealed together, a distance between the edge portions of the neck portion being the same or smaller than a distance between bent lines of the bent portions of the gusset portions, the upper portion of the neck portion forming a upper pouring spout opened by tearing, a tear position instruction portion indicating a tear position on the neck being provided on an edge portion of a heat seal portion in the neck portion, the front surface portion and the rear surface portion being made from laminate sheets, and at least one of the front surface portion and the rear surface portion being formed with perforations formed through all but at least one layer of the laminate sheet across the entire width of the neck portion at a position corresponding to the tear direction instruction portion, the upper portion of the straw extending to a position in the neck portion above the position of the perforations, a positioning means for maintaining position of the straw with respect to the main body portion, the positioning means being provided between the neck portion and the upper portion of the straw in the neck portion, the neck portion being capable of being opened following the perforations from the tear instruction portion and over the upper portion of the straw.

Because the tear position instruction portion indicating the tear position on the neck is provided on an edge heat seal portion of the neck portion, and because the distance between the edge portions of the neck portion is the same or smaller than the distance between bent lines of the bent portion of the gusset portions so that the front surface portion and the rear surface portion are directly fused together, a predetermined region that corresponds to the tear position instruction portion has a weak strength, so that the container can be easily torn to open it up.

Also, because the front surface portion and the rear surface portion are made from a laminate sheet and because the perforations are formed on at least one of the front surface portion and the rear surface portion and through all but at least one layer of the laminate sheet across the entire width of the neck portion at a position that corresponds to the tear direction instruction portion, the tearing strength of the laminate sheet is reduced at the perforation portion. The consumer can use his or her fingers to easily tear open the neck portion following the perforation portion from the tearing instruction portion to over the upper portion of the straw. Also, because the perforations are covered up, and do not penetrate through, the front surface portion and the rear surface portion, leaks from the beverage container can be prevented.

Further, because the positioning means for maintaining position of the straw with respect to the main body portion is provided between the neck portion and the upper portion of the straw in the neck portion, while the container is in the process of being opened and after the container has been opened the straw can be maintained protruding from the pouring spout by the amount that the straw extends from the position of the perforations, without the straw sinking into the main body portion of the liquid container.

BRIEF DESCRIPTION OF DRAWINGS

FIG. 14(*b*) shows a process for covering perforations on one side of the laminate film in the first concrete example of a method for forming perforations; and FIG. 14(*c*) shows the state in which 20-micron thick straight-chain low-density polyethylene film 5C' is laminated to cover the perforations in a second concrete example of a method of forming perforations;

BEST MODE FOR CARRYING OUT THE INVENTION

Figure 1:
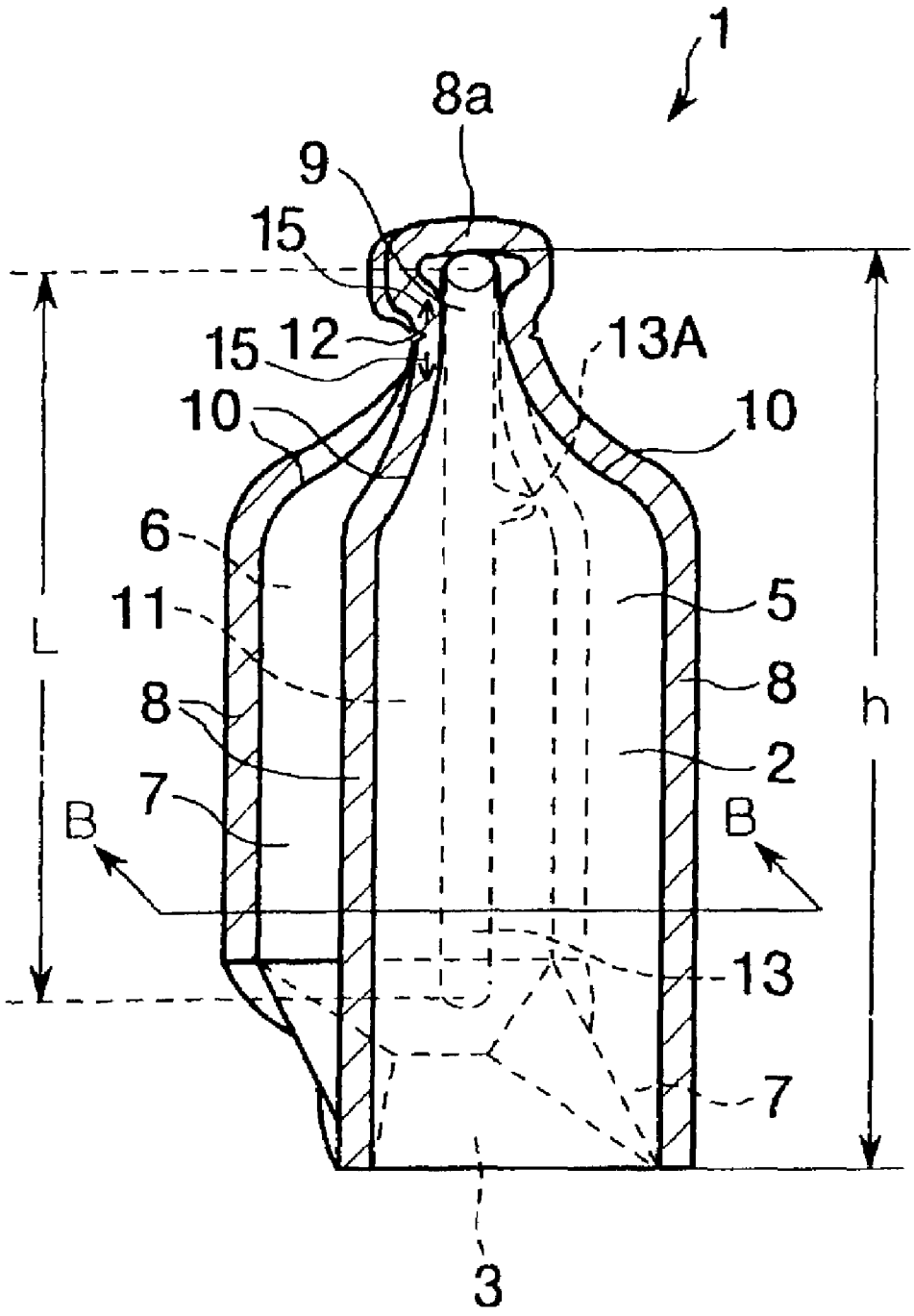
FIG. 1 is a perspective view showing a beverage container according to a first embodiment of the present invention, wherein the container is filled with beverage.
Figure 2:
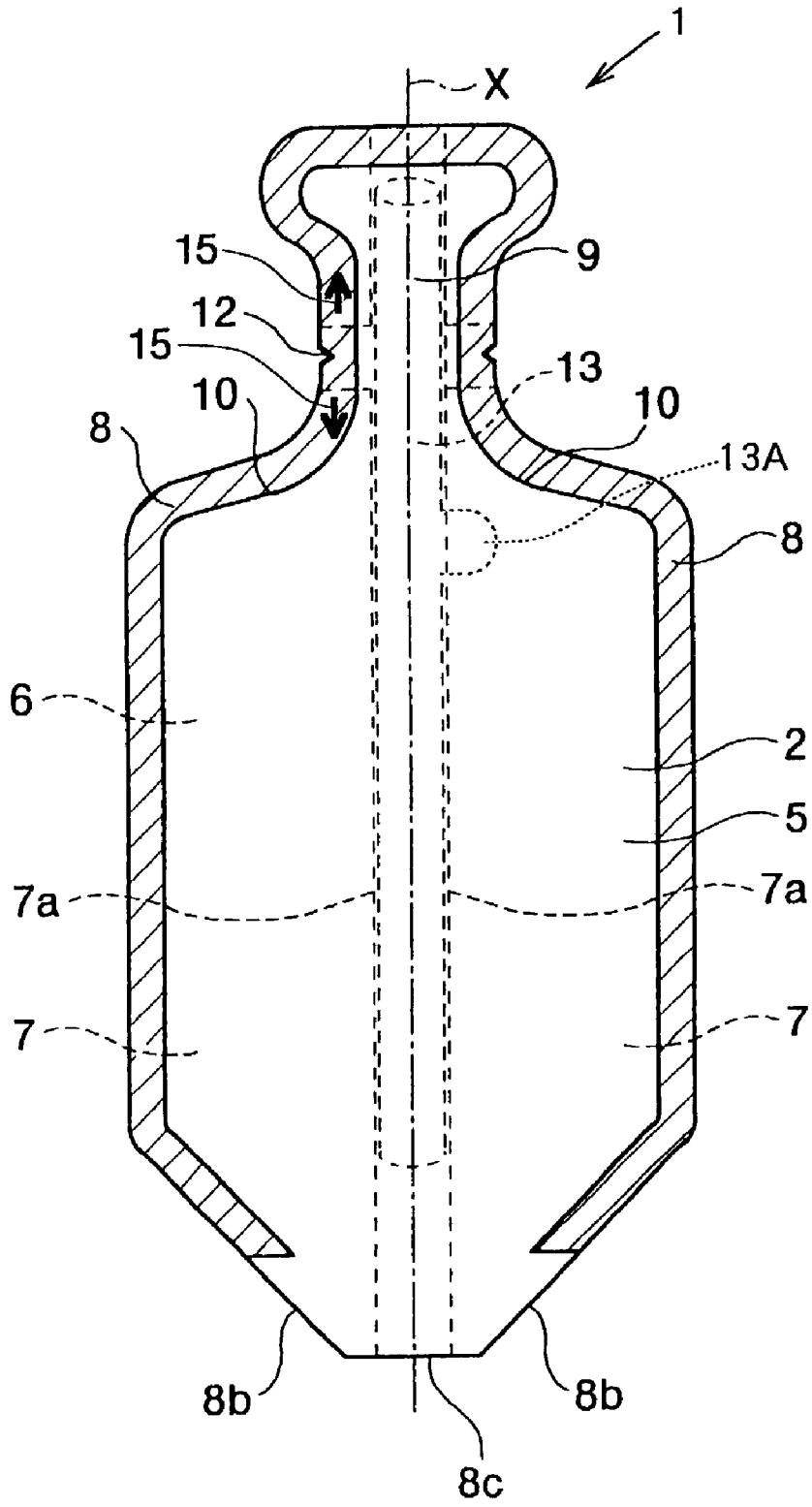
FIG. 2 is a front view showing the beverage container of the first embodiment of the present invention, before being filled with beverage.

A beverage container and manufacturing process therefor according to a first embodiment of the present invention will be described with reference to FIGS. 1 to 7. FIG. 1 shows a beverage container 1 filled with a beverage. The beverage container 1 has a main body portion 2 containing the beverage. The main body portion 2 is configured from base portion 3, a front surface portion 5, a rear surface portion 6, and a pair of gusset portions 7, 7. The rear surface portion 6 has the same shape as the front surface portion 5. The pair of gusset portions 7, 7 form the side portion that connects the front surface portion 5 and the rear surface portion 6. The gusset portions 7, 7 are formed (FIG. 2) by being folded inward into a V-shape in cross section at fold portions 7*a*, 7*a*. The gusset portions 7, 7 are fused to the front surface portion 5 and the rear surface portion 6 by heat sealing and the like. That is, a heat seal portion 8 having a width of between 3 mm and 5 mm is formed by heat sealing the left and right edges of the front surface portion 5 to one edge of each of the gusset portions 7, 7, and by heat sealing the left and right edges of the rear surface portion 6 to the other edge of each of the gusset portions 7, 7. As shown in FIG. 2, before being filled with liquid, the fold portions 7*a*, 7*a* of the gussets portions 7, 7 are positioned symmetrically in parallel with a lengthwise direction centerline X of the main body portion 2.

The upper portion of the front surface portion 5 and the rear surface portion 6 has a narrower width than the remainder of the front surface portion 5 and the rear surface portion 6. The upper portion includes a neck portion 9 that extends vertically and shoulder portions 10 that slant gently downward from the neck portion 9. The neck portion 9 is shaped like the neck of a bottle. The neck portion 9 is disposed on the lengthwise direction centerline X (FIG. 2) of the main body portion 2. The shoulder portions 10, 10 are symmetrical on left and right sides of the centerline X.

A main filling portion 11 that holds the beverage is formed from the remainder of the front surface portion 5 of the main body portion 2 besides the neck portion 9 and the shoulder portion 10, the remainder portion of the rear surface portion 6 besides the neck portion 9 and the shoulder portion 10, and the gusset portions 7, 7, which configure a connection side portion that connects these two remainder portions. The cross-section taken along the line B of the main filling portion 11 is substantially square shaped. In order to form the base portion 3 shown in FIG. 1, the lower edge of the gusset portions 7, 7 and the lower edges of the front surface portion 5 and the rear surface portion 6 are configured as shown in FIG. 2 with a pair of symmetrical slanting edge portions 8*b*, 8*b* and a central edge portion 8*c*.

Figure 3:
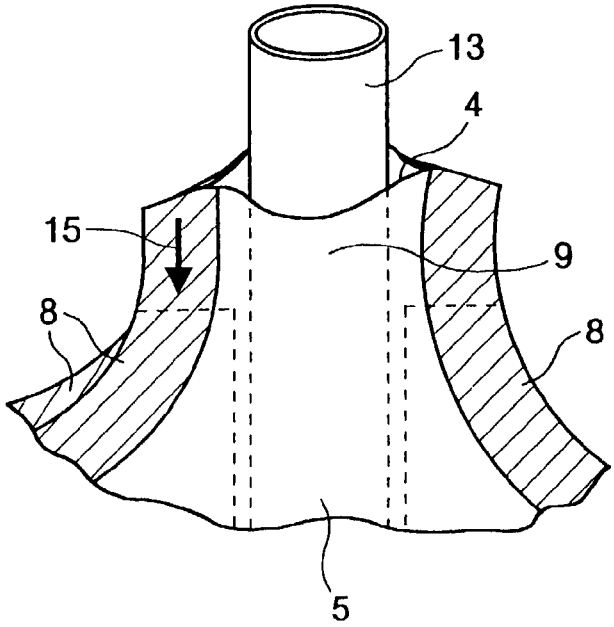
FIG. 3 is an enlarged partial cross-sectional view showing a neck portion and a straw of the beverage container according to the first embodiment of the present invention, in the condition when the straw protrudes from a pouring spout.

A straw 13 for sipping the beverage is disposed within the main body portion 2. The straw 13 is made from a material such as resin with a specific gravity less than that of the beverage filling the main body portion 2. The straw 13 is provided with a protrusion portion 13A that protrudes from the outer peripheral surface of the straw 13 in a direction that is perpendicular to the lengthwise direction of the straw 13. The straw 13 has a length L that is shorter than a height h of the container after being filled with beverage. Also, as shown in FIG. 3, the inner peripheral length of the pouring spout 4 is formed longer than the outer peripheral length of the straw 13. It should be noted that according to the present embodiment the straw 13 is not formed long enough to reach the base portion 3 of the beverage container 1. However, because the container overall has a flexible configuration, the container will contract when the beverage is sipped out. Therefore, it is possible to drink all the beverage without leaving any fluid in the container.

The front surface portion 5 and the rear surface portion 6 are configured from laminated sheets of flexible plastic material (resin film). A concrete example is use of a three-layer laminate film made from 12-micron thick biaxial orientation polyethylene terephthalate (PET) film, 15-micron thick biaxial orientation nylon film, and 20- to 80-micron thick straight-chain low-density polyethylene film.

Also, it is desirable that the gusset portions 7, 7 be configured from a material that is softer than the front surface portion 5 and the rear surface portion 6. A concrete example material is the use of a two-layer laminate film made from 15-micron thick biaxial orientation nylon film and 120-micron thick straight-chain low-density polyethylene film.

PET film is a material with excellent heat resistance, and with providing shape stability. It is used in bag making processes to ensure consistency in dimensions. PET film also has the advantage of being easily processed during formation processes by heat sealing. Biaxial orientation nylon film has excellent toughness and is used to obtain a desired strength to withstand handling and transport, without making the beverage container overly bulky. The straight-chain low-density polyethylene film has thermal adhesive properties and is used to form the beverage container 1 by heat sealing. Also, this material has good toughness, although not to the extent of biaxial orientation nylon film. In the embodiment, the front surface portion 5 and the rear surface portion 6 are made from a transparent material. As a result, the position of the straw 13 inside the main body portion 2 can be confirmed from outside the main body portion 2. It should be noted that because PET film and the biaxial orientation nylon film provide orientation, they can be easily torn by matching the tear tracks (to be described later) with the orientation direction. Accordingly, the straight-chain low-density polyethylene film, which has no orientation, should be formed to a thickness that can be torn. Also, the straight-chain low-density polyethylene film has a certain amount of toughness. Therefore, although it is an easily stretchable material that is difficult to tear, it can be easily torn when used in a laminate with the orientation film.

It should be noted that a container meeting with ministerial ordinances for milk and dairy produces can be provided if a straight-chain low-density polyethylene film containing no slip additive is used as the lamination film.

A V-shaped notch 12 (tear position indication portion) for starting the tear in the neck portion 9 is formed in the heat seal portion 8 of the neck portion 9. Although the gusset portions 7, 7 also form the neck portion, the edge portions of the front surface portion 5 and the rear surface portion 6 are directly fused to each other at a predetermined region that corresponds to the position of the notch 12, where no gusset portions 7, 7 are present. The upper portion of the straw 13 is positioned extending into the neck portion 9 and extends to above where the notch 12 is formed.

Tear direction indication portions, such as arrow marks 15, are formed by printing on the heat seal portion 8 near the neck portion 9. The tear direction indication portions tell the consumer to grasp opposite sides of the notch 12, with one hand toward the top of the neck portion and the other hand toward the base portion, and to tear in mutually opposite directions along the same line. For example, opening is easy by grasping the sealed edge portion with the fingers of both hands on either side of the notch 12. If the left hand is pulled downward as viewed in FIG. 1 and the right hand is pulled upward as viewed in FIG. 1, then a tear starts with the notch 12 as the starting point. The heat seal portion 8*a* of the upper portion of the neck 9 is removed by pulling it over the upper part of the straw 13. When the beverage container 1 is opened by removing the heat seal portion 8*a*, then as shown in FIG. 3 the pouring spout 4 for pouring beverage, which is the contents of the container, is formed. At this time, because the straw 13 is made from a material with a specific gravity lower than that of the beverage filling the main body portion 2 and because the inner peripheral length of the pouring spout 4 is formed longer than the outer peripheral length of the straw 13, it is possible that the straw 13 may move upward from the pouring spout 4 by buoyancy of the straw 13. However, because the protrusion portion 13A is provided at the lengthwise center position of the straw 13, the protrusion portion will engage with the inner peripheral surface of the neck portion once the straw 13 moves somewhat from the pouring spout. By this, the straw 13 can be blocked from protruding excessively out from the pouring spout 4 and the straw overall can be prevented from separating from the main body portion. It should be noted that the straw is fixed to the main body portion in an embodiment to be described later, so that the straw does not float up. However, the above-described protrusion portion 13A is extremely effective in case the straw is not properly fixed. Therefore, the protrusion portion 13A can be provided to the straw as needed in the subsequently-described embodiment.

Next a process for making the beverage container of the first embodiment will be described.

Figure 4:
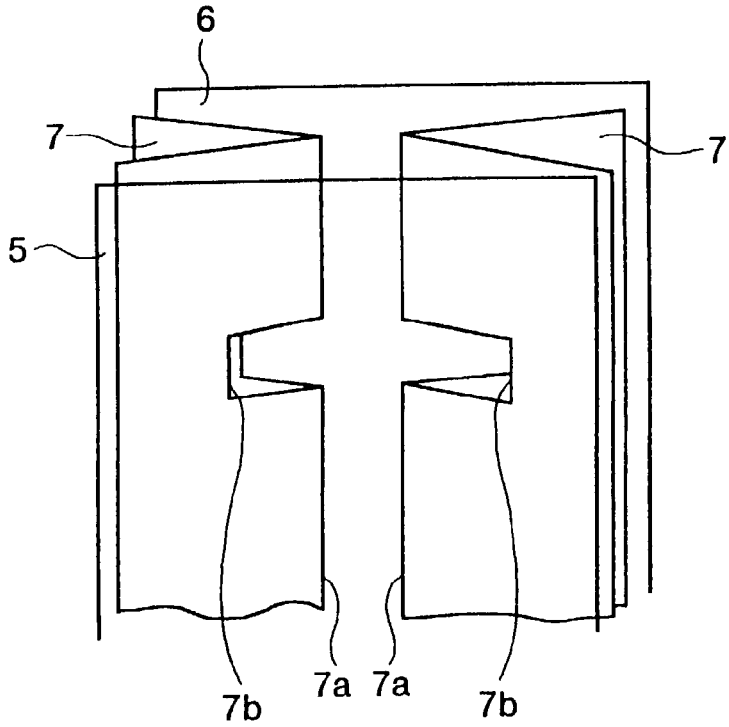
FIG. 4 is a view showing stacked laminate sheets constituting a front surface portion, the gusset portions, and a rear surface portion, during a process for making the beverage container of the first embodiment of the present invention.
Figure 5:
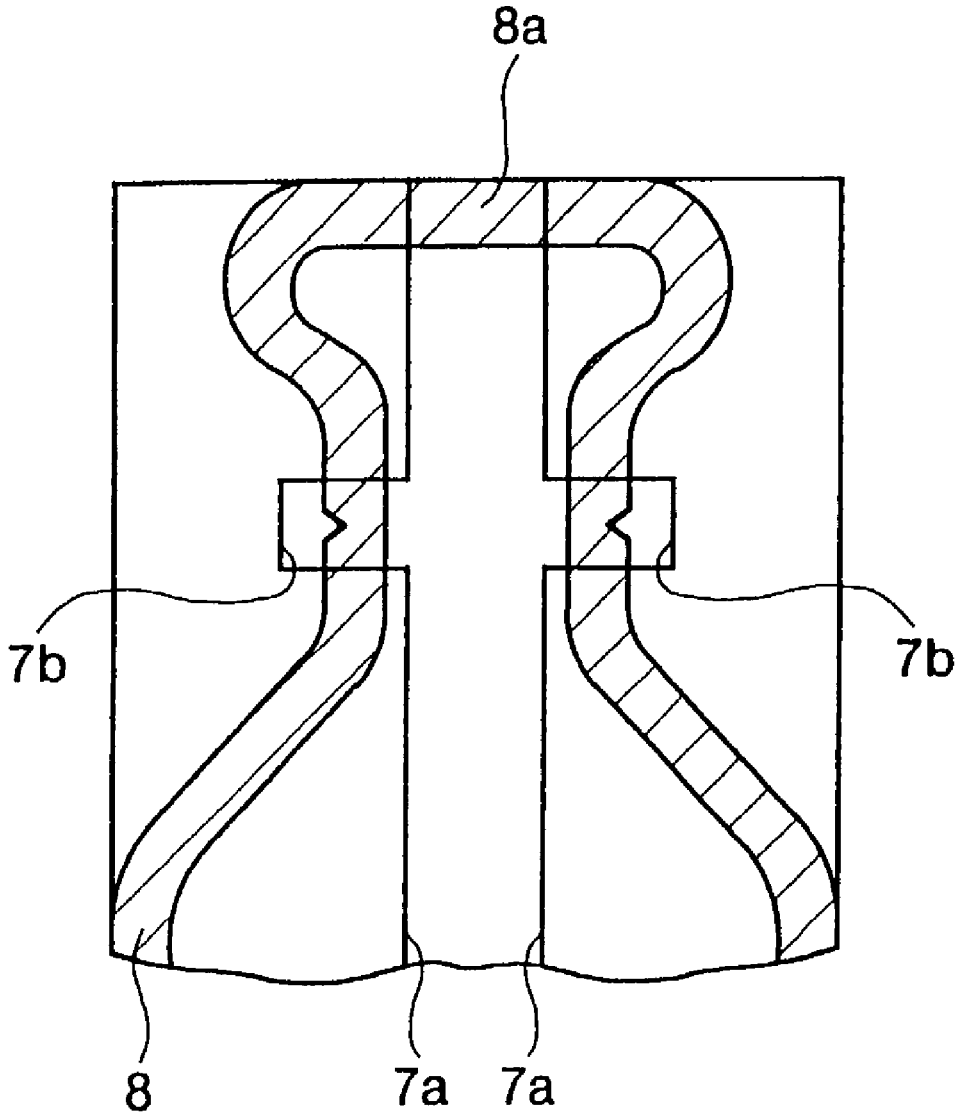
FIG. 5 is a view showing the heat sealed stacked laminate sheets for the front surface portion, the gusset portions, and the rear surface portion during a process for making the beverage container of the first embodiment of the present invention.
Figure 6:
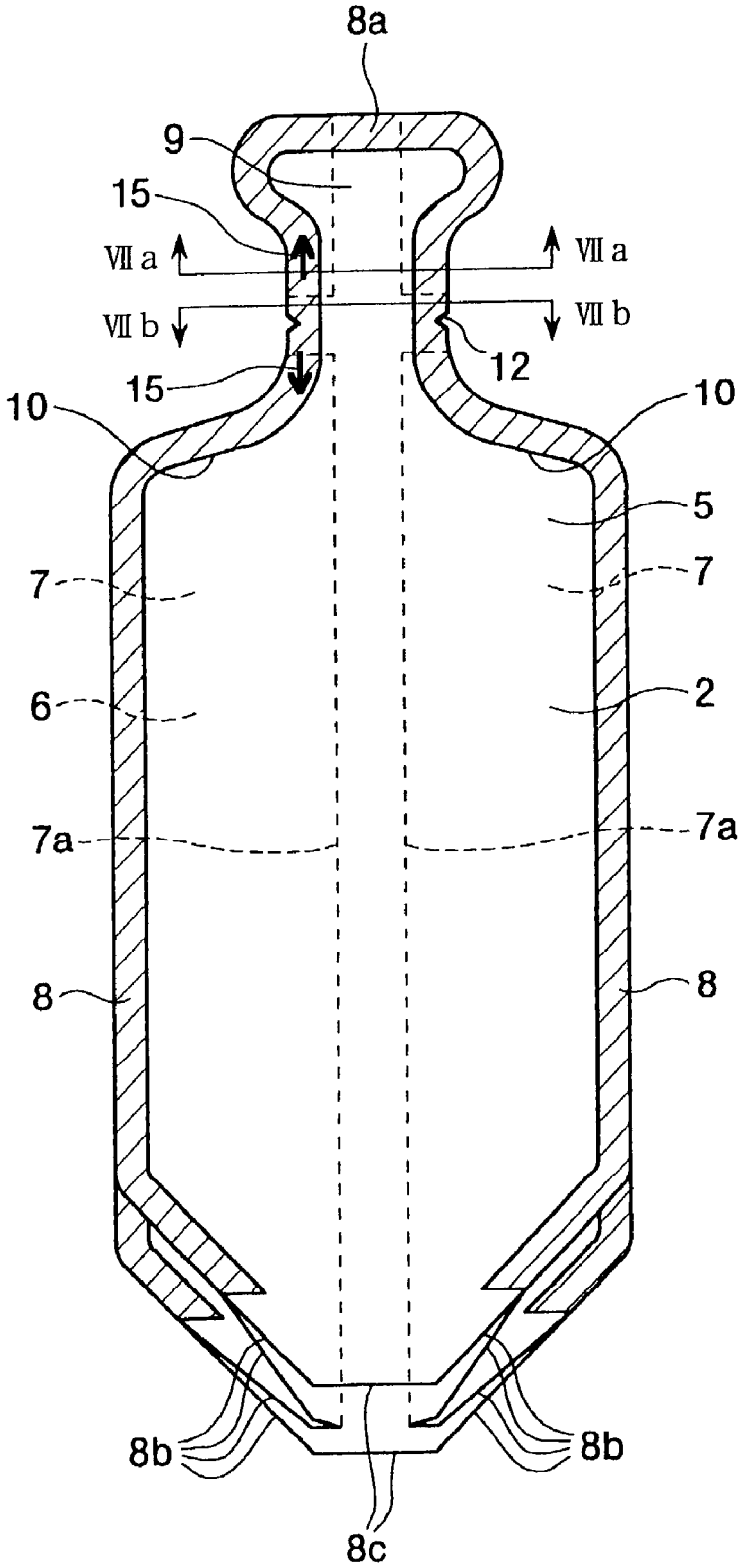
FIG. 6 is a view showing the front surface portion, the gusset portions, and the rear surface portion heat sealed together in a condition cut to the shape of the beverage container during a process for making the beverage container of the first embodiment of the present invention.
Figure 7:
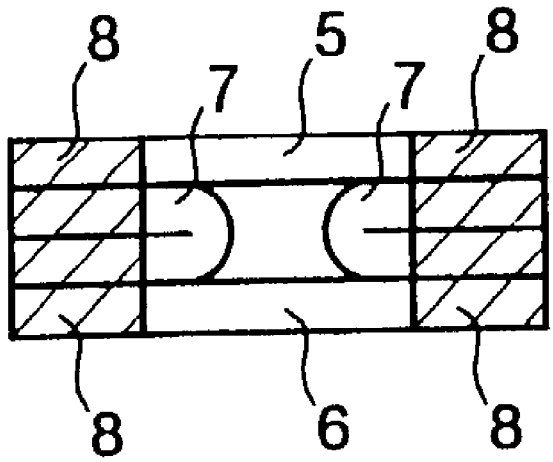
FIGS. 7(*a*) and 7(*b*) are cross-sectional views, and FIG. 7(*a*) is a view taken along the line VIIa—VIIa of FIG. 6 and, FIG. 7(*b*) is a view taken along line VIIb—VIIb of FIG. 6.
Figure 7:
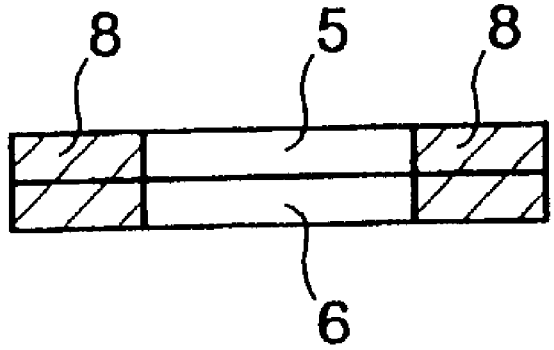

Laminate sheets configuring the front surface portion 5, the gusset portions 7, 7, and the rear surface portion 6 are stacked as shown in FIG. 4. Cut out portions 7*b*, 7*b* are formed in the bent portions 7*a*, 7*a* in the laminate sheets that form the gusset portions 7, 7. Then as shown in FIG. 5, the laminated objects of the front surface portion 5, the gusset portions 7, 7 and the rear surface portion 6 are subjected to a heat seal 8 having the shape of the main body portion 2 of the beverage container 1. At this time, the front surface portion 5 and the gusset portions 7, 7, and the rear surface portion 6 and the gusset portions 7, 7, are fused. However, the front surface portion 5 and the rear surface portion 6 are fused directly together where no gusset portion 7 exists at the portion equivalent to the cut out portions 7*b*, 7*b* and the portion 8*a* between the bent portions 7*a*, 7*a*. Further, as shown in FIG. 6 the laminate sheets are cut in the shape of the main body portion 2 of the liquid container 1. FIG. 7 is a cross-sectional view of the stacked and fused front surface portion 5, gusset portions 7, 7, and the rear surface portion 6. As shown in FIG. 7(*a*), the front surface portion 5 and the gusset portions 7, 7, and the rear surface portion 6 and the gusset portions 7, 7, are fused at the portion where the gusset portions 7, 7 exist and, as shown in FIG. 7(*b*), the front surface portion 5 and the rear surface portion 6 are fused directly together at the portion equivalent to the cut out portions 7*b*, 7*b*.

Before the beverage container 1 manufactured in the above-described manner is filled with beverage (FIG. 2), the straw 13 is supported at a position between the bent portions 7*a*, 7*a*. By this, the straw 13 is supported at a position where there is no gusset portion 7 so that the main body portion 2 is thin. When a plurality of the main body portions 2 are stacked together and transported, these will not be bulky and so is convenient.

When the beverage container 1 is filled with beverage, then as shown in FIG. 1 the beverage container becomes a stable three-dimensional body by the V-shape of the gusset portions 7, 7 opening up. The base 3 has an approximately square shape when the beverage container 1 is full of beverage, so the beverage container 1 can be stably stood up with the base 3 down and the neck portion 9 up.

When, based on the information indicated by the arrow marks 15, the neck portion is pulled on either side of the notch in mutually opposite directions on the same line and, moreover, in upward and downward directions parallel with the straw 13, the force that acts on the front surface portion and the rear surface portion can be constantly concentrated at the lead of the tear, in the same manner that force is concentrated on the deep part of the notch 12. Also, the tearing force will concentrate at the lead of the tear track when the tear track reaches the heat seal portion at the side opposite from the side formed with the notch 12. Therefore, the tear can be easily continued even at the opposite side heat seal portion. Thus, the tear can be reliably executed in the direction cutting across the neck portion, and therefore, the heat seal portion 8*a* at the upper portion of the neck portion 9 can be completely removed. Also, even if the tear track of the front surface portion and the rear surface portion are slightly displaced from each other, the force acting on the front surface portion and the rear surface portion is concentrated at the lead of the tear track. Therefore, the tear can be easily continued at the front-surface heat seal portion opposite from the notch 12 and the rear-surface heat seal portion opposite from the notch 12. The heat seal portion 8*a* at the upper portion of the neck portion 9 can be completely removed. As a result, the heat seal potion 8*a* at the upper portion of the neck portion will not brush against the consumer's face while the consumer is sipping the beverage.

Only the front surface portion 5 and the rear surface portion 6 exist, and no gusset portion 7 exists, at the portion where the tear is generated. Therefore, less force is required to make the tear than if the gusset portions 7 existed up to the portion where the tear is generated. Further, because the tearing action is in mutually opposite directions along the same line and, moreover, in directions parallel with the straw, the tear will always ride over the upper portion of the straw 13. Therefore, the upper portion of the straw 13 will not interfere with the tear track. Accordingly, the neck portion 9 can be easily opened by being passed over the upper portion of the straw 13.

Figure 8:
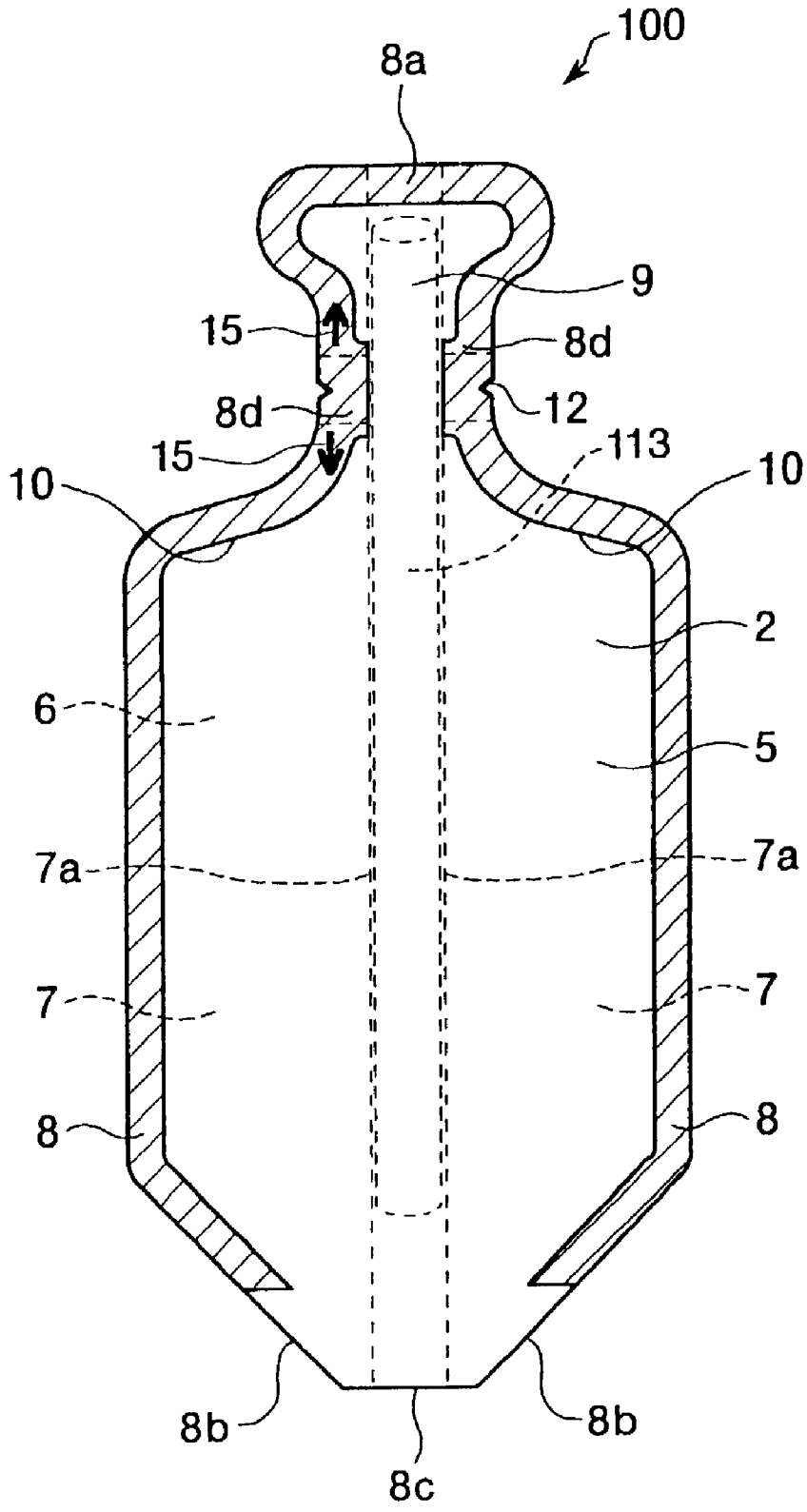
FIG. 8 is a front view showing a beverage container according to a second embodiment of the present invention, before the container is filled with beverage.

Next, a beverage container 100 according to a second embodiment of the present invention will be described with reference to FIG. 8. Like parts and components are designated by the same reference numerals as those shown in the first embodiment to avoid duplicating description. A straw 113 disposed in the main body portion 2 of the beverage container 100 of the present embodiment is not provided with the protrusion portion 13A of the straw 13 of the first embodiment. Also, near the notch 12, the heat seal 8 extends to near the outer peripheral surface of the upper portion of the straw 113, forming a support portion 8*d* that supports the straw 113. By this, the pouring spout 4 formed when the heat seal portion 8*a* is taken off to open the beverage container 1 clings intimately to the outer periphery of the straw 113 and the straw 113 is supported by the support portion 8*d*. Accordingly, when the container is in the process of being opened and after the container has been opened, the straw 113 can be maintained in a condition protruded from the pouring spout 4, without sinking down into the main body portion 2 of the liquid container 100. In a configuration where the straw 113 is fixed to the main body portion 2, the straw 113 serves as a framework for the flexible container 100 when the container is opened and makes the container easier to grasp with fingers. As a result, the container is even easier to open up. Further, by having the straw 113 fixed to the main body portion 2, the straw 113 will not sink down, so there is no need for the user to search around for the straw after the container is opened.

Figure 9:
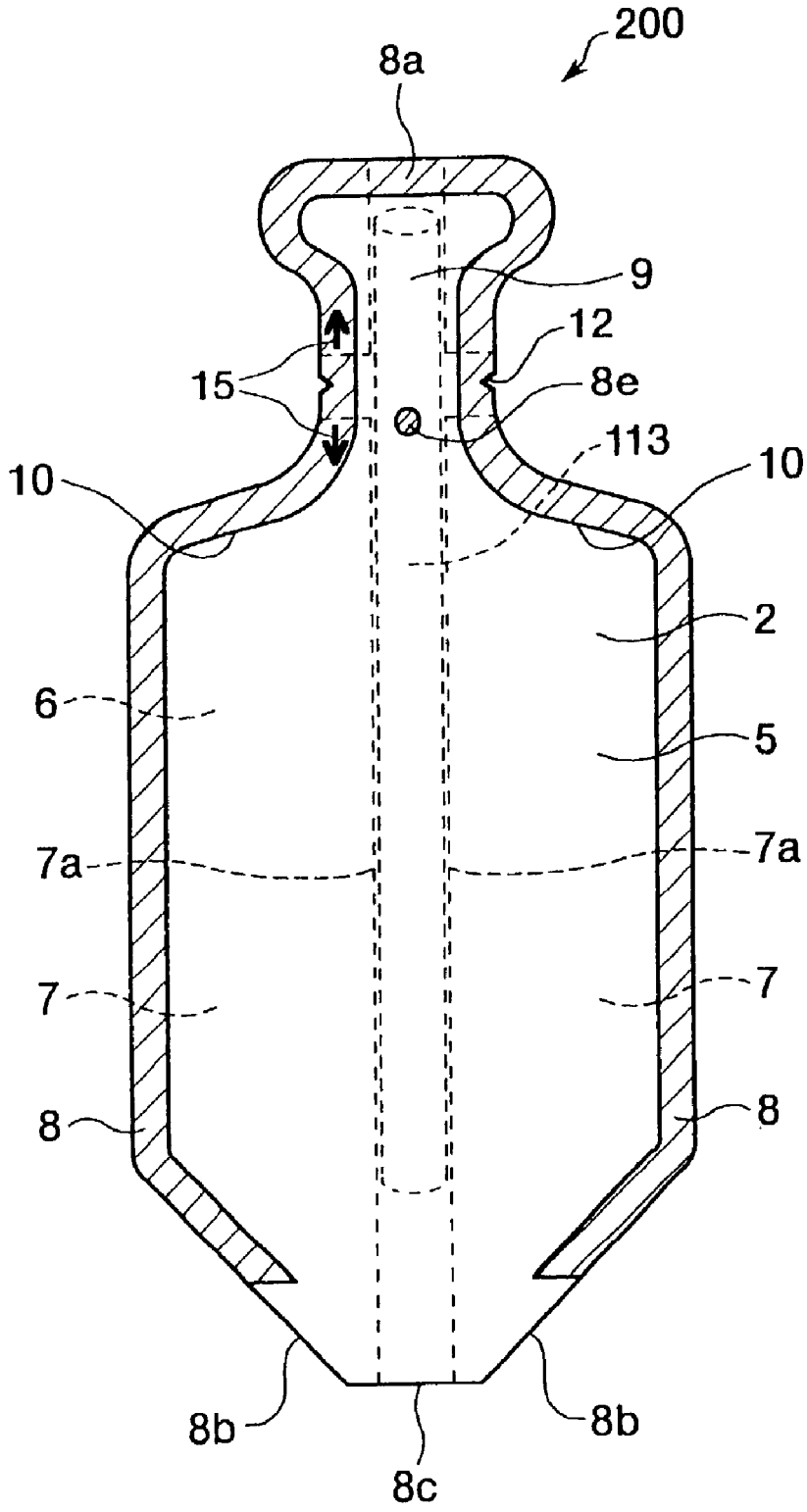
FIG. 9 is a front view showing a beverage container according to a third embodiment of the present invention, before the container is filled with beverage.

Next, a beverage container 200 according to a third embodiment of the present invention will be described with reference to FIG. 9. The same reference numbering will be used for components having the same configuration as in the first embodiment and explanation will be omitted. The beverage container 200 according to the present embodiment has the same straw 113 as in the second embodiment disposed in the main body portion 2. Further, the straw 113 is connected to the front surface portion 5 by a point seal portion 8*e* formed by heat sealing, the point seal portion being positioned at the upper part of the straw 113 and below the notch 12. Accordingly, while the container is in the process of being opened and after the container is opened up, the straw 113 can be maintained in a condition protruded from out of the pouring spout 4 without sinking into the main body portion 2 of the liquid container 200. It should be noted that although the point seal portion 8*e* is provided to the front surface portion 5 side in the present embodiment, the point seal portion 8*e* could be provided to the rear surface portion 6 side instead, or to both the front surface portion 5 side and the rear surface portion 6 side.

Next, a beverage container 300 according to a fourth embodiment of the present invention will be described with reference to FIG. 10. The same reference numbering will be used for components having the same configuration as in the first embodiment and explanation will be omitted. The beverage container 300 according to the present embodiment has a straw 313 provided with a bellows 313A.

The straw 313 is connected to the front surface portion 5 at the position of the bellows 313A by a point seal portion 8*f* formed by heat sealing, so that the bellows 313A is positioned near the top portion of the straw 313 and below the notch 12. Accordingly, while the container is in the process of being opened and after the container has been opened the straw 113 will be maintained in a condition protruding from the pouring spout 4 without sinking into the main body portion 2 of the liquid container 300. Because more material is concentrated at the bellows 313A than at other portions of the straw 313, the straw 313 can be prevented from being crushed by pressure, heat, and the like when the point seal portion 8*f* is formed by heat sealing at the position of the bellows 313A. Also, the beverage is easy to sip because the bellows 313A can be easily deformed. It should be noted that although the point seal portion 8*f* was provided on the front surface portion 5 side in the present embodiment, the point seal portion 8*f* could be provided on the rear surface portion 6 side instead, or on both the front surface portion 5 side and the rear surface portion 6 side.

Figure 11:
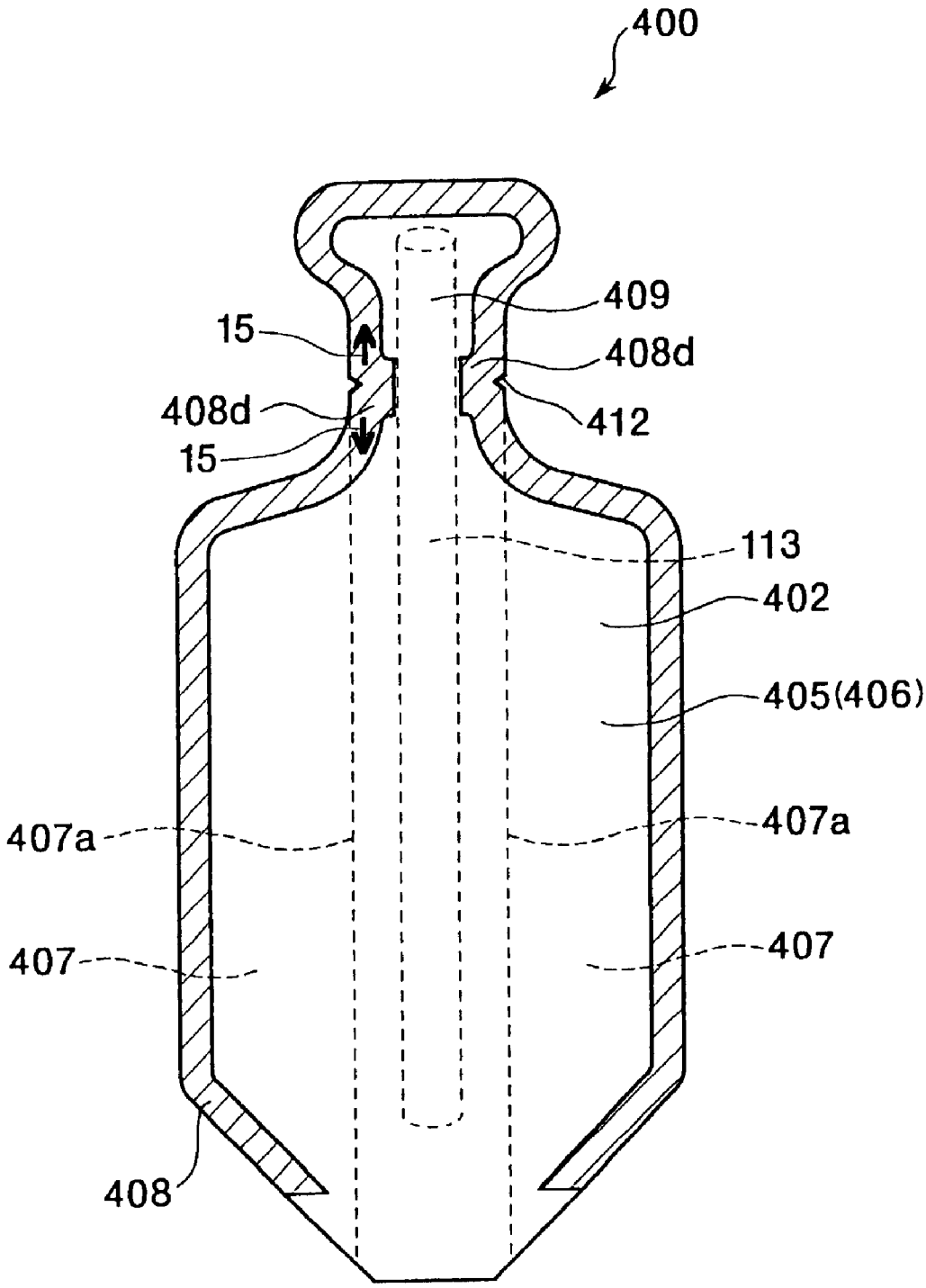
FIG. 11 is a front view showing a beverage container according to a fifth embodiment of the present invention, before the container is filled with beverage.
Figure 12:
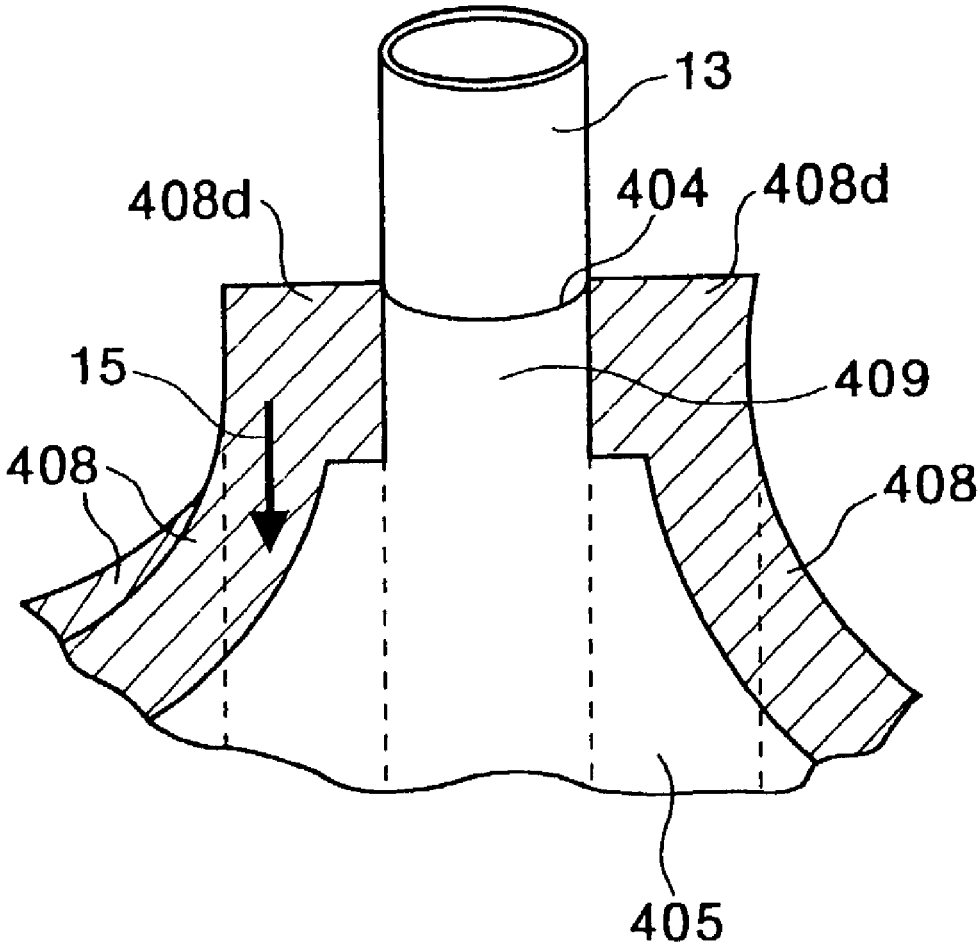
FIG. 12 is an enlarged partial cross-sectional view showing a neck portion and a straw of the beverage container according to the fifth embodiment of the present invention, in the condition when the straw protrudes from the pouring spout.

Next, a beverage container 400 according to a fifth embodiment of the present invention will be described with reference to FIGS. 11 and 12. The same numbering will be used for components having the same configuration as in the first embodiment and explanation will be omitted.

According to the present embodiment, the confronting edge portions are thermally fused directly together, without an interposing gusset portion, at the entire slender portion of the upper portion of a front surface portion 405 and a rear surface portion 406 of the main body portion. For this reason, the distance between the edge portions of the neck portion 409, that is, the distance between the outer edges of the heat seal portions, is as long or shorter than the distance between bent portions 407*a*, 407*a* of gusset portions 407, 407. Said differently, the edge portions of the front surface portion 405 and the rear surface portion 406 are thermally fused together directly at the neck portion 409, without the side portions of the gusset portions 407, 407 being interposed therebetween. It should be noted that the upper end of the neck portion 409 forms a cap shape, and that the distance between the edge portions of the neck portion 409 is formed longer than the distance between the bent portions 407*a*, 407*a* of the gusset portions 407, 407. However, this is an exception and merely a matter of design. Also, in the same manner as the second embodiment, the heat seal 408 extends to the outer peripheral surface at the upper portion of the straw 113 near the notch 412 and forms a support portion 408*d* for supporting the straw 113 without providing any protrusion portion to the straw 113. The upper portion of the straw 113 extends to a position that is within the neck portion 409 and that is above where the notch 412 is formed.

The consumer grasps the container with fingers of both hands on either side of the V-shaped notch 412. Then, based on the instruction of the tear direction instruction portion 15, the consumer pulls in mutually opposite directions and in directions extending in the direction that the straw 113 extends. As a result, a tear is generated starting at the notch 412 and the user removes the upper side of the neck portion over the upper portion of the straw 113. At this time, because only the front surface portion 405 and the rear surface portion 406 exist where the tear is generated, and the gusset portions 407 do not exist at all at that portion, less tearing force is needed than if the gussets 407 existed to the portion where the tear is generated. Because the tear is in the above-described direction, the tear force will be concentrated at the deepest portion of the tear line. Therefore, tearing is easily started and the neck portion 409 can be opened while passing over the upper portion of the straw 113. By opening the container, a pouring spout for pouring out beverage, which is the contents of the container, is formed as shown in FIG. 12.

Also, as described above, the heat seal 408 near the notch 412 extends to the outer peripheral surface of the upper portion of the straw 113 and forms a support portion 408d for supporting the straw 113. By this, the pouring spout 404 formed when the beverage container 400 is opened by removing the heat seal portion 408*a* is in intimate contact with the outer periphery of the straw 113 as shown in FIG. 12 and the straw 113 is supported by the support portion 408*d*. Accordingly, while the container is in the process of being opened and after the container has been opened, the straw 113 will be maintained in a condition protruded out from the pouring spout 404, without sinking inside the main body portion 402 of the liquid container 400.

Figure 13:
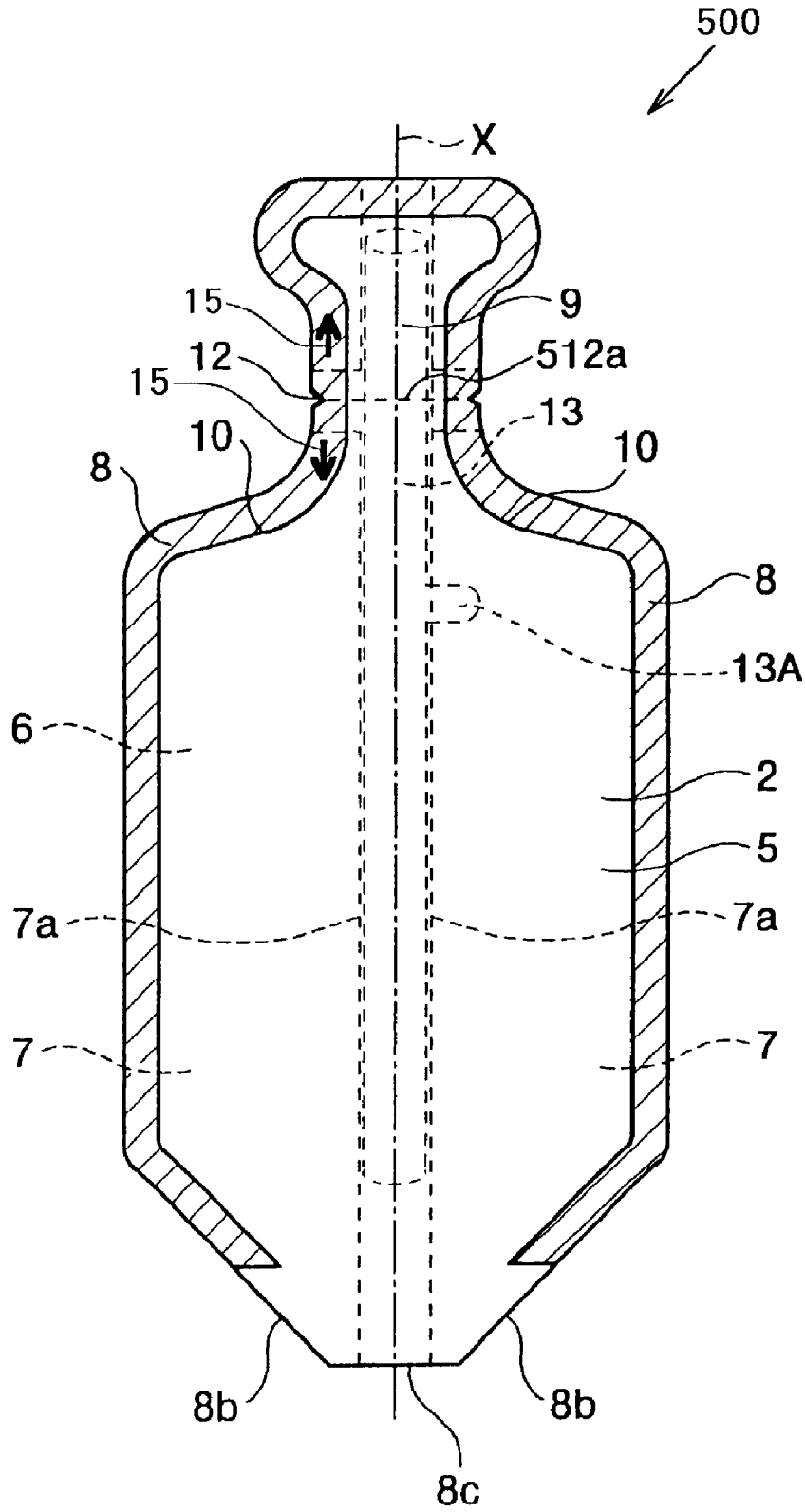
FIG. 13 is a front view showing a beverage container according to a sixth embodiment of the present invention, before the container is filled with beverage.

Next, a beverage container 500 according to a sixth embodiment will be described with reference to FIG. 13. The present embodiment has substantially the same configuration as the first embodiment. Perforations 512*a* are formed in the beverage container 500 of the present embodiment across the entire width of the neck portion 9 at a position corresponding to the notch 12 in a direction that cuts across a lengthwise direction central line X of the main body portion 2. The perforations 512*a* penetrate through all but at least a single layer of the laminate sheet that configures the front surface portion 5 and the rear surface portion 6. However, because the perforations 512*a* do not penetrate through at least one layer of the laminate sheet that configures the front surface portion 5 and the rear surface portion 6, the front surface portion 5 and rear surface portion 6 themselves are not pierced. The perforation lines 512*a* of the front surface portion 5 and the perforations 512*a* of the rear surface portion 6 overlap with each other.

Next, a method for forming the perforation 512*a* will be described. As described above, the front surface portion 5 and the rear surface portion 6 are formed from a three-layer laminate film including 12-micron thick polyethylene terephthalate (PET) film, 15-micron thick biaxial orientation nylon film, and 80-micron thick straight-chain low-density polyethylene film. Although hereinafter manufacturing processes will be explained for the laminate sheet that configures the front surface portion 5, processes performed on the laminate sheet that configures the rear surface portion 6 are the same.

Figure 14:
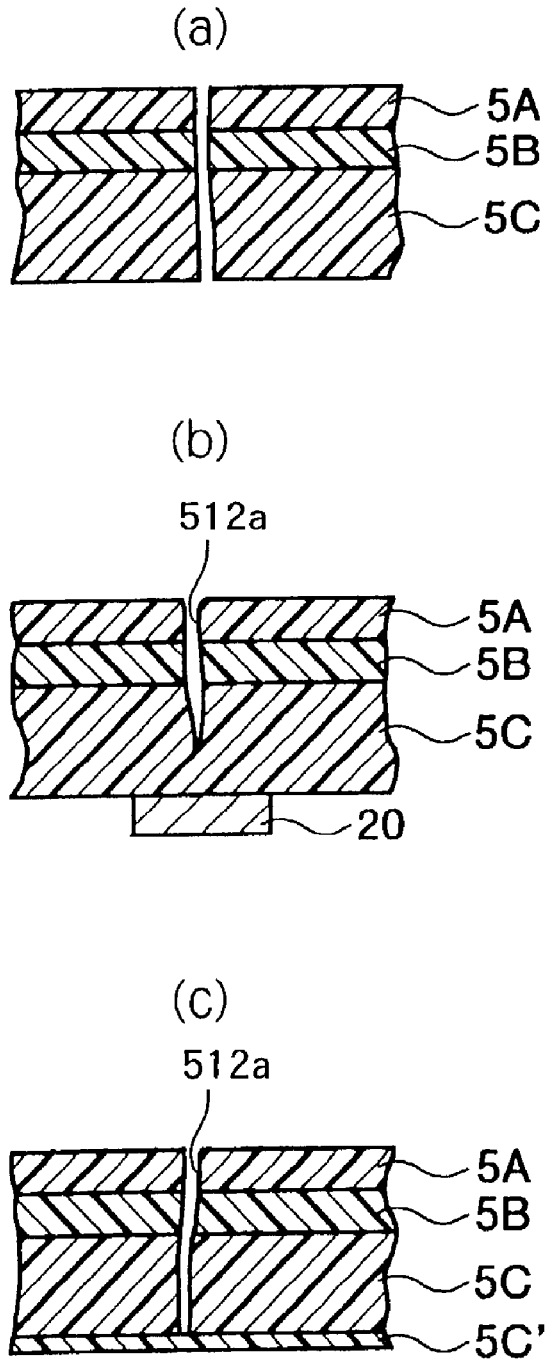
FIGS. 14(*a*) through 14(*c*) are enlarged partial cross-sectional views showing perforations formed in a front surface portion of the beverage container according to the sixth embodiment of the present invention, wherein FIG. 14(*a*) shows the condition wherein the perforations are formed penetrating through the laminate sheet in a first concrete example of a method for forming the perforations.

In a first concrete example of a method for forming the perforations 512*a*, as shown in FIG. 14(*a*) perforations are formed through all of a polyethylene terephthalate film layer 5A, a biaxial orientation nylon film layer 5B, and a straight-chain low-density polyethylene film layer 5C. Afterward, as shown in FIG. 14(*b*) a process is performed to cover up the perforations, which pierce through the laminate film overall, in one surface of the laminate film by heat sealing the surface of the straight-chain low-density polyethylene film layer 5*c* by contact with a heat seal bar 20 and the like. In this way, perforations 512*a* are formed that pierce through the polyethylene terephthalate film layer 5A and the biaxial orientation nylon film layer 5B, but which do not pass through the straight-chain low-density polyethylene film layer 5C. By such a formation method, the perforations can be formed, and the perforations can be closed up both during the bag manufacturing process.

As a second concrete example of a method for forming the perforations 512*a*, first as shown in FIG. 14(*c*) a three-layer laminate film is prepared by laminating together a 12-micron thick polyethylene terephthalate film layer 5A, a 15-micron thick biaxial orientation nylon film 5B, and a 60-micron thick straight-chain low-density polyethylene film layer 5C. Then perforations that pierce through these films are formed. Afterward, a 20-micron thick straight-chain low-density polyethylene film layer 5C' is laminated onto the surface of the 60-micron thick straight-chain low-density polyethylene film layer 5C. In this way, perforations 512*a* can be provided that penetrate through only the polyethylene terephthalate film layer 5A, a 15-micron thick biaxial orientation nylon film 5B, and a 60-micron thick straight-chain low-density polyethylene film layer 5C. By using this method, the straight-chain low-density polyethylene film layer 5C' is laminated onto the laminate sheet formed with perforations, then rolled into a roll shape and bag manufacturing processes are performed.

In this way, the tearing strength of the laminate sheet is reduced by the formation of the perforations 512*a*. Therefore, the consumer can open the beverage container 1 even more easily by tearing the container with his or her fingers and removing the heat seal portion 8*a* of the upper portion of the neck portion 9 over the upper portion of the straw 13. On the other hand, the perforations 512*a* are covered and do not penetrate through the front surface portion 5 and the rear surface portion 6, so that leaks from the beverage container 1 can be prevented.

Figure 15:
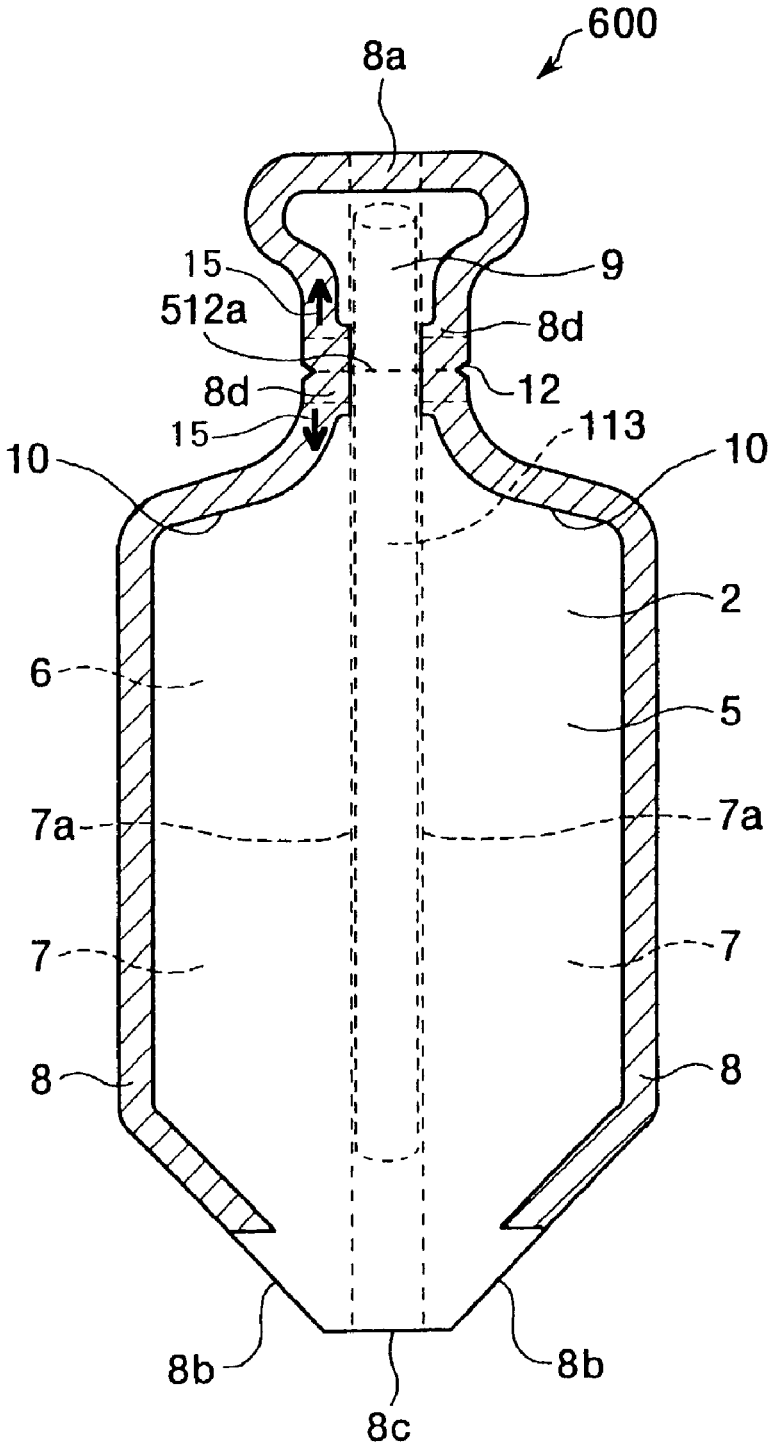
FIG. 15 is a front view showing a beverage container according to a seventh embodiment of the present invention, before the container is filled with beverage.

A beverage container 600 according to a seventh embodiment will be described with reference to FIG. 15. The present embodiment has the same configuration as the second embodiment. Perforations 512*a* are formed in the beverage container 600 of the present embodiment at the position corresponding to the notch 12 in the same way as in the beverage container 500 of the sixth embodiment. By this, the same effects can be achieved as for the beverage container 100 of the second embodiment and also the beverage container is even easier to open.

Figure 16:
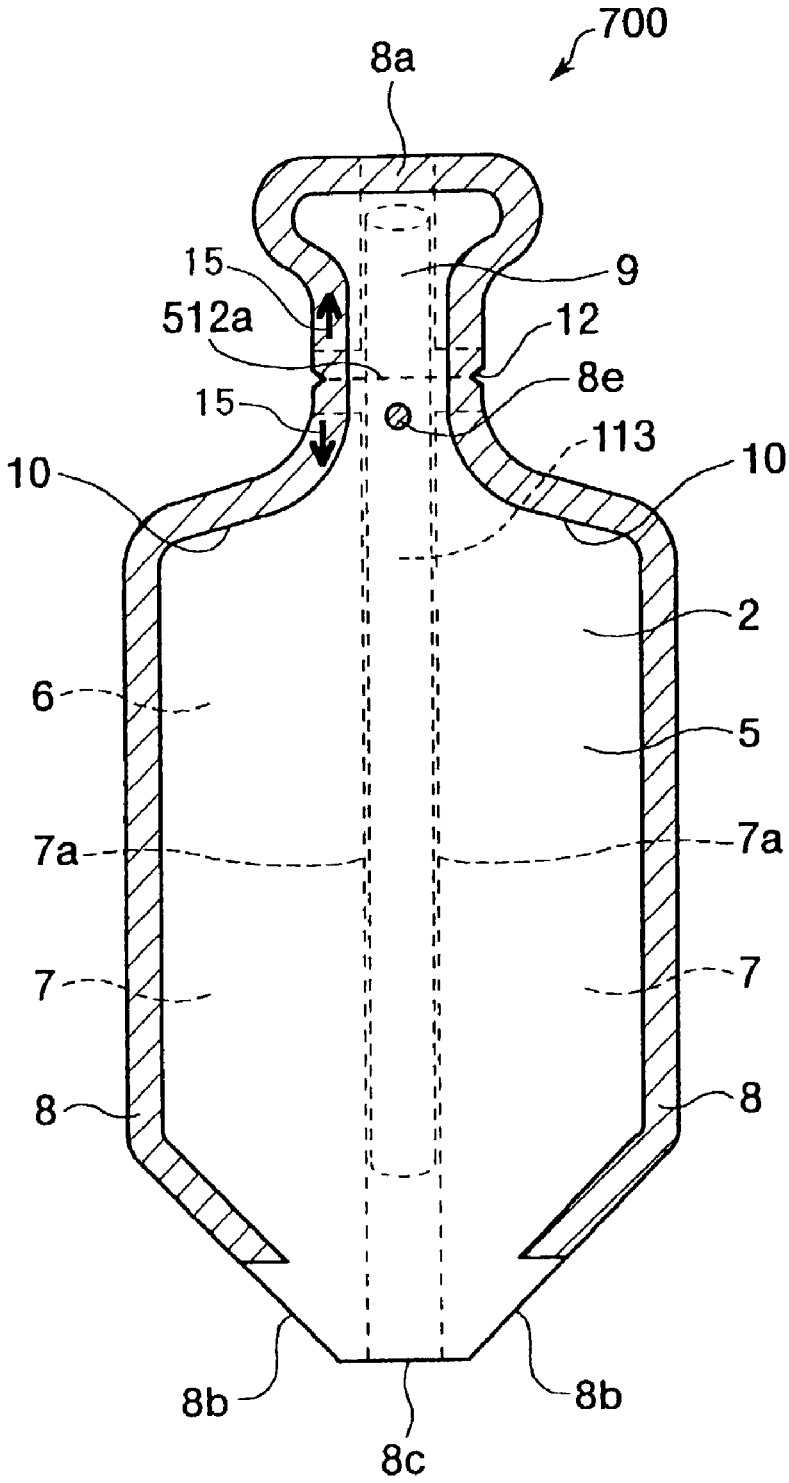
FIG. 16 is a front view showing a beverage container according to an eighth embodiment of the present invention, before the container is filled with beverage.

A beverage container 700 according to an eight embodiment will be described with reference to FIG. 16. The present embodiment has the same configuration as the third embodiment. Perforations 512*a* are formed in the beverage container 700 of the present embodiment at the position corresponding to the notch 12 in the same way as in the beverage container 500 of the sixth embodiment. By this, the same effects can be achieved as for the beverage container 200 of the third embodiment and also the beverage container is even easier to open.

Figure 17:
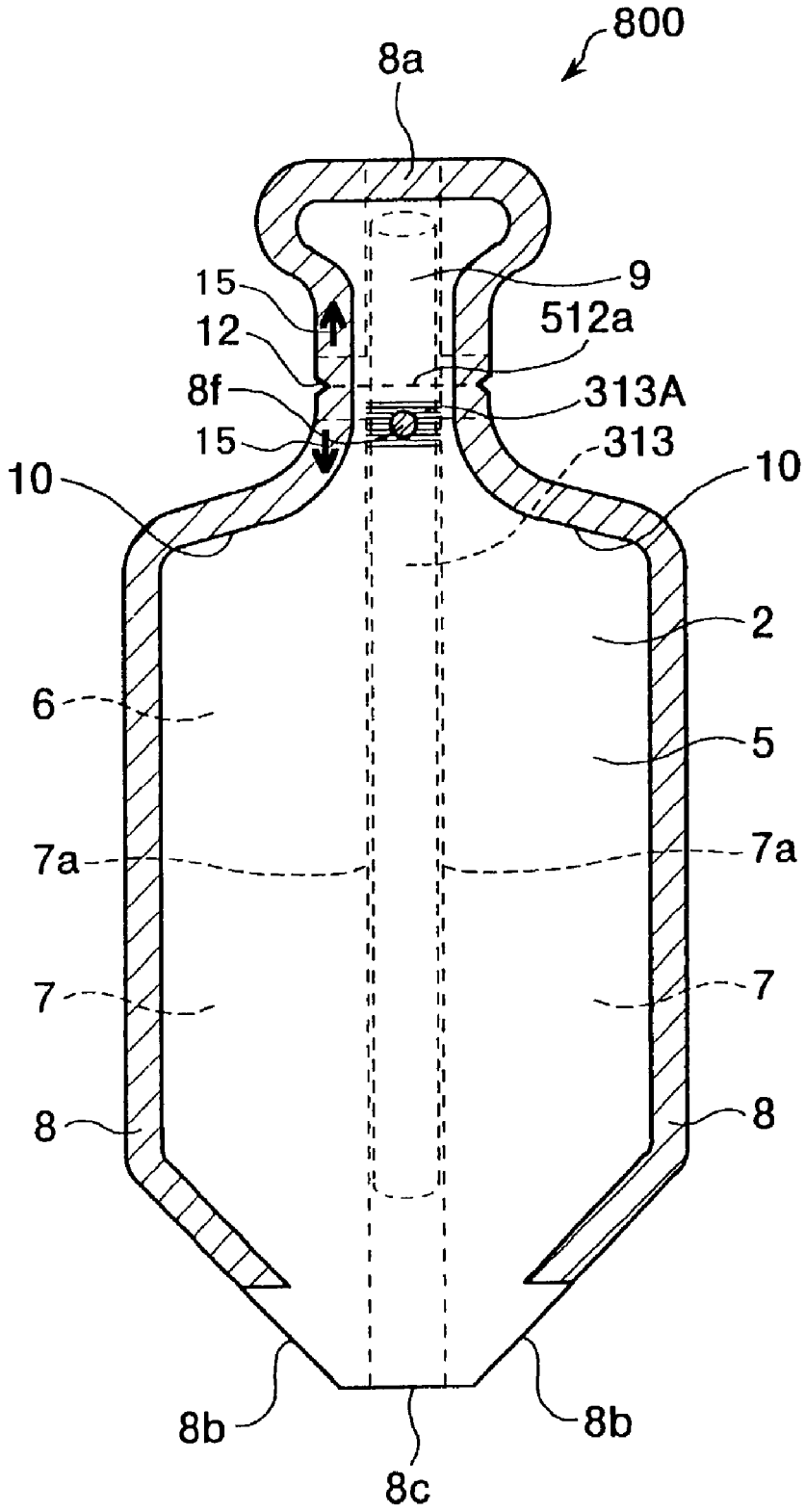
FIG. 17 is a front view showing a beverage container according to a ninth embodiment of the present invention, before the container is filled with beverage.

A beverage container 800 according to a ninth embodiment will be explained based on FIG. 17. The present embodiment has the same configuration as the fourth embodiment. Further, perforations 512*a* are formed in the beverage container 800 of the present embodiment at the position corresponding to the notch 12 in the same way as in the beverage container 500 of the sixth embodiment. By this, the same effects can be achieved as for the beverage container 300 of the fourth embodiment and also the beverage container is even easier to open.

Figure 18:
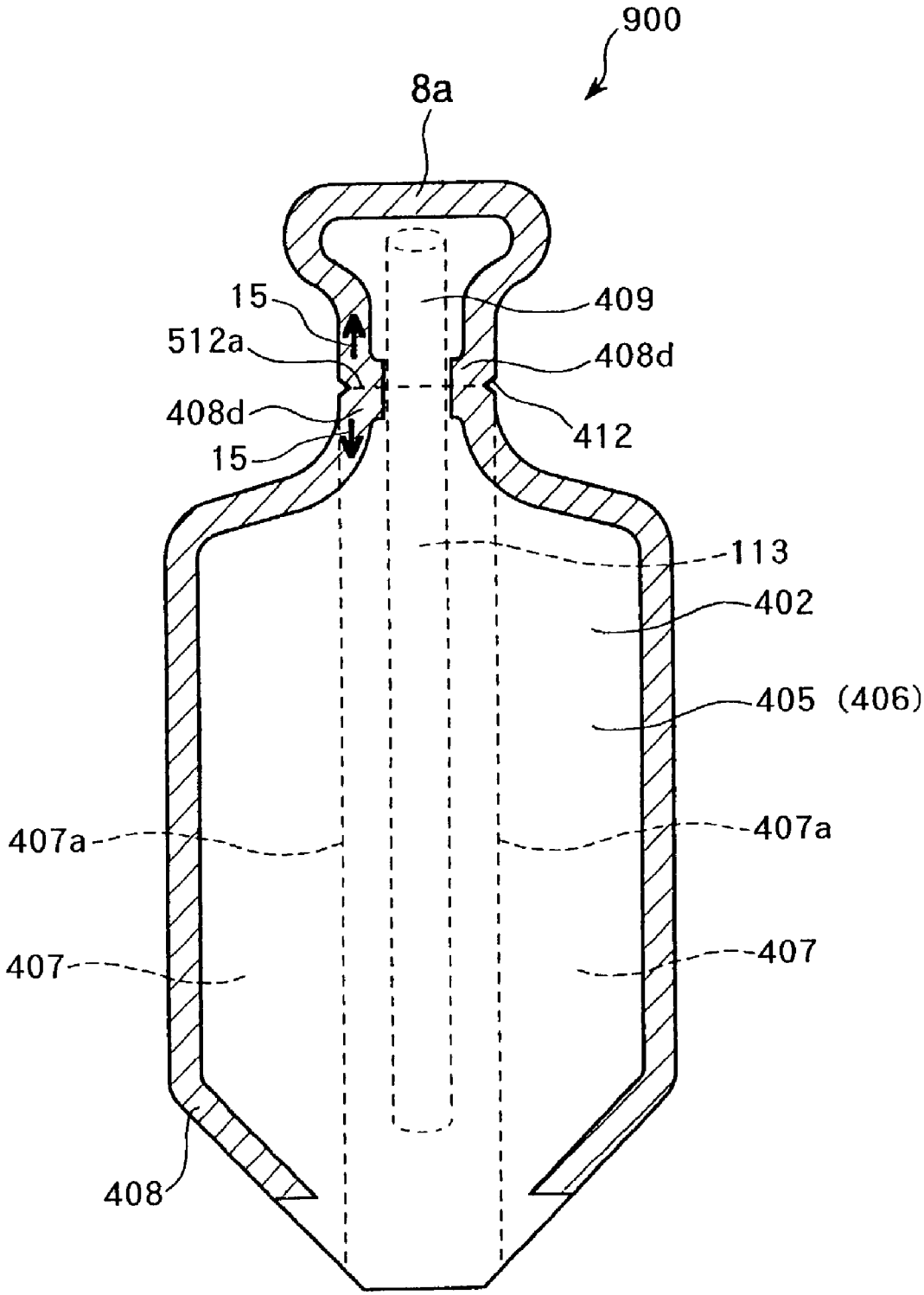
FIG. 18 is a front view showing a beverage container according to a tenth embodiment of the present invention, before the container is filled with beverage.

A beverage container 900 according to a tenth embodiment will be explained based on FIG. 18. The present embodiment has the same configuration as the fifth embodiment. Further, perforations 512*a* are formed in the beverage container 900 of the present embodiment at the position corresponding to the notch 12 in the same way as in the beverage container 500 of the sixth embodiment. By this, the same effects can be achieved as for the beverage container 400 of the fifth embodiment and also the beverage container is even easier to open.

Figure 19:
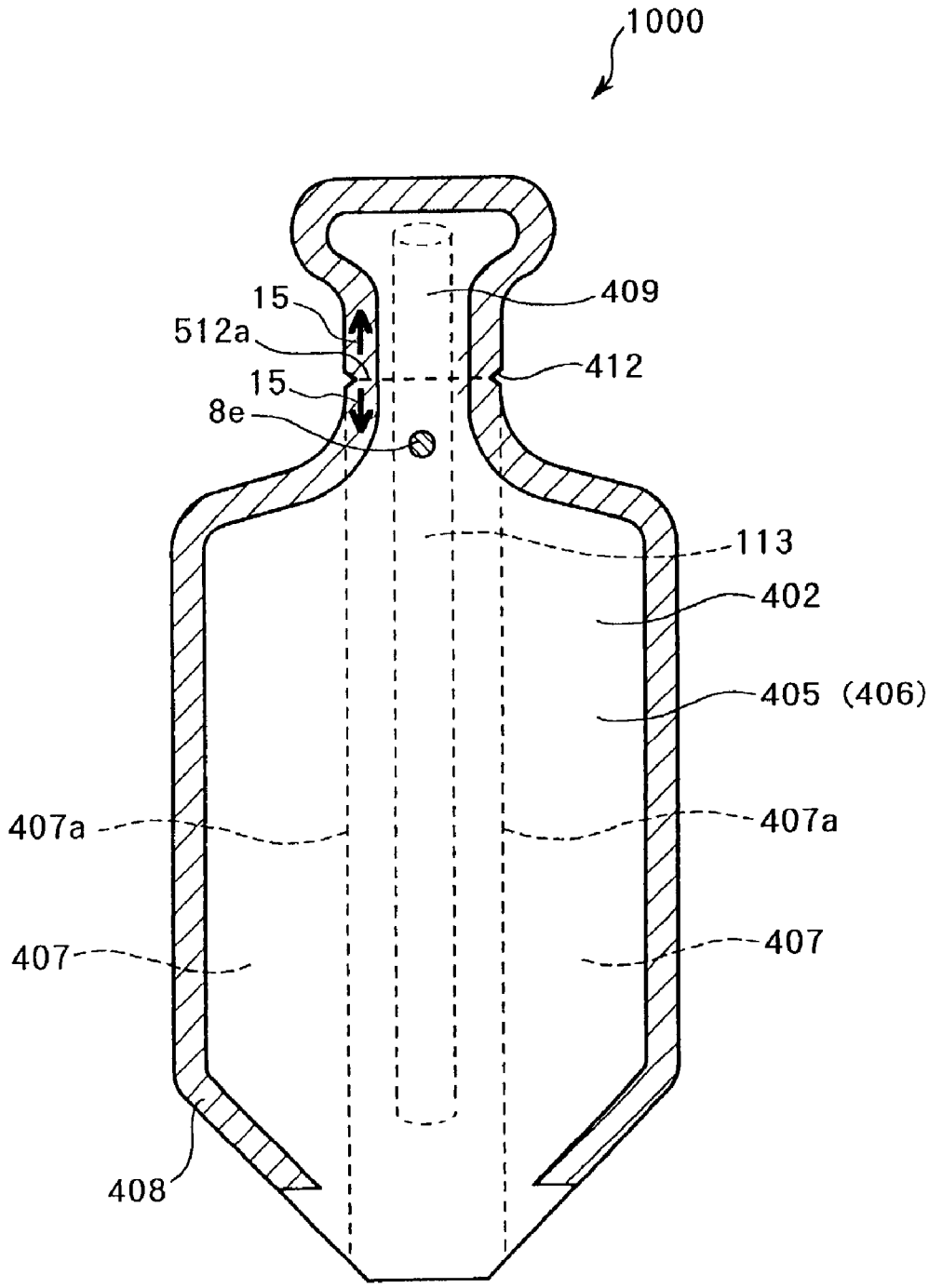
FIG. 19 is a front view showing a beverage container according to an eleventh embodiment of the present invention, before the container is filled with beverage.

A beverage container 1000 according to an eleventh embodiment will be explained based on FIG. 19. The present embodiment has the same configuration as the tenth embodiment, but is formed with no support portions 408*d*. However, in the same manner as the beverage container 200 of the third embodiment, the position at the upper portion of the straw 113 and below the notch 412 is connected to the front surface portion 405 by a point seal portion 8*e* formed by heat sealing. Accordingly, the same effects can be achieved as for the beverage container 200 of the third embodiment and also the beverage container is even easier to open.

Figure 20:
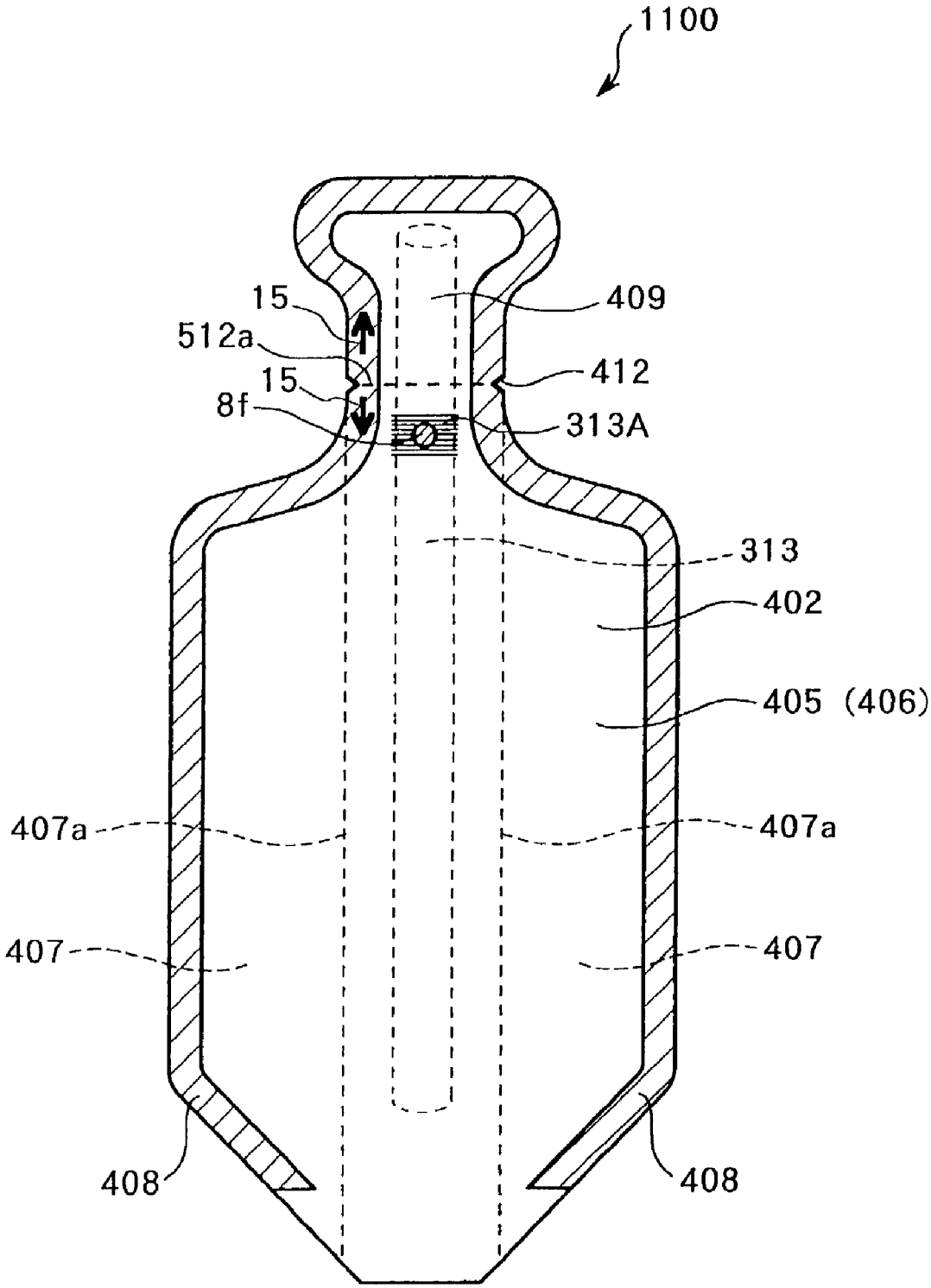
FIG. 20 is a front view showing a beverage container according to a twelfth embodiment of the present invention, before the container is filled with beverage.

A beverage container 1100 according to a twelfth embodiment will be explained based on FIG. 20. The present embodiment has the same configuration as the tenth embodiment, but is formed with no support portions 408*d*. However, in the same manner as the beverage container 300 of the fourth embodiment, a bellows 313A is provided in the straw 313. The bellows 313A is formed at the upper portion of the straw 113 and below the notch 412. The straw 313 is connected at the position of the bellows 313A to the front surface portion 405 by a point seal portion 8*e* formed by heat sealing. Accordingly, the same effects can be achieved as for the beverage container 300 of the fourth embodiment and also the beverage container is even easier to open.

The beverage container according to the present invention is not limited to the above-described embodiments buy various changes and modifications can be made within the scope of claims.

For example, the notch for starting the tear in the neck portion has a V shape in the above-described embodiments. However, the notch could have an I shape instead. Also, the notch could be formed to both the left and right sides of the neck portion edge or to only one side.

In the first embodiment and the fifth embodiment, a tear direction instruction portion is provided near the neck portion. The tear direction instruction portion instructs the consumer to grasp both sides of the notch and tear in opposite directions of the same line, that is, in the direction toward the top of the neck portion with one hand and toward the base of the container with the other hand. However, the position of the instruction portion is not limited to near the neck portion. Further, the tear direction instruction portion need not be printed, but could be a stick-on seal or label, with instructions such as the tearing direction, attached to any one of the front surface portion, the rear surface portion, and the gusset portions.

Further, in the fifth embodiment, the surface area of the heat seal portion near the notch 412 is enlarged to configure the straw support portion 408*d*. However, a straw provided with point seal such as in the third embodiment shown in FIG. 9 could be used instead.

Figure 10:
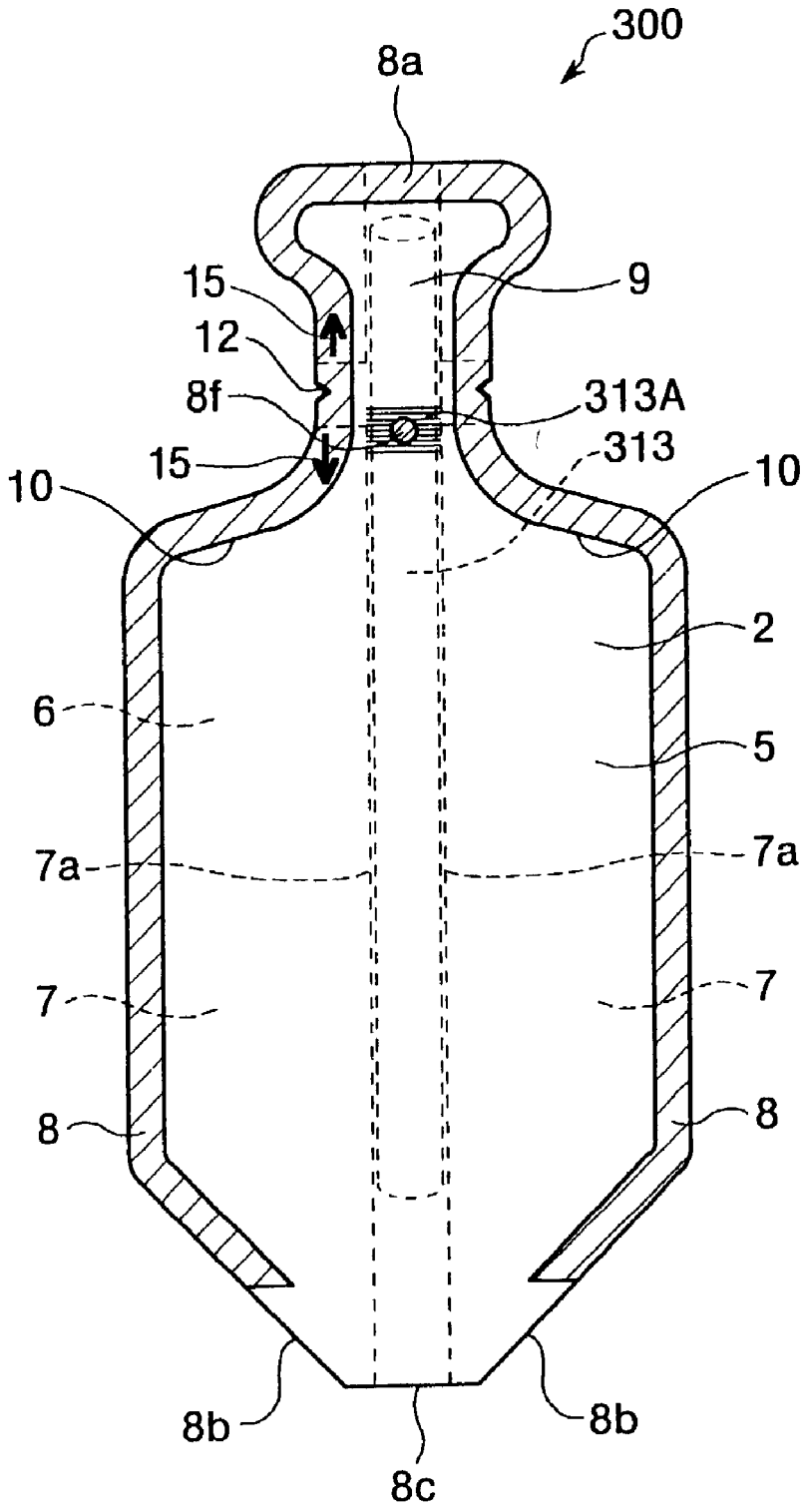
FIG. 10 is a front view showing a beverage container according to a fourth embodiment of the present invention, before the container is filled with beverage.

Further, in the fifth embodiment, a bellows could be provided to the straw and a point seal could be imparted on the bellows in the same way as in the fourth embodiment shown in FIG. 10.

Further, in the first embodiment and the sixth embodiment, the inner peripheral length of the portion of the neck portion 9 that is higher than the pouring spout can be made shorter than the outer peripheral length of the straw. By doing this, in a state before tearing the neck portion, the upper end of the straw can be engaged with and be fixed in place by the inner periphery of the neck portion above the pouring spout. Consequently, the straw will not float up in the vertical direction due buoyancy in the beverage while the container is being filled up with beverage through the bottom opening, so the straw will not get in the way when the beverage is being filled in through the bottom opening. As a result, the container can be easily filled with the beverage while supporting the straw in the main body portion without the beverage dispensed from a filling machine being interfered with the straw.

Figure 21:
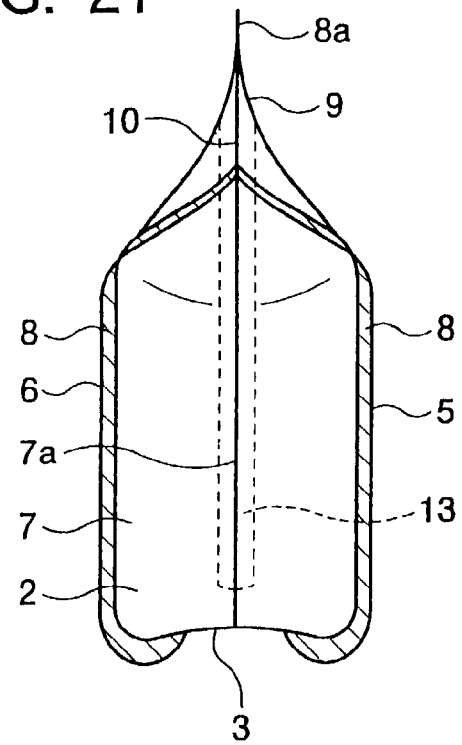
FIG. 21 is a side view showing a modification of the beverage container according to an embodiment of the present invention, after the container has been filled with beverage.
Figure 22:
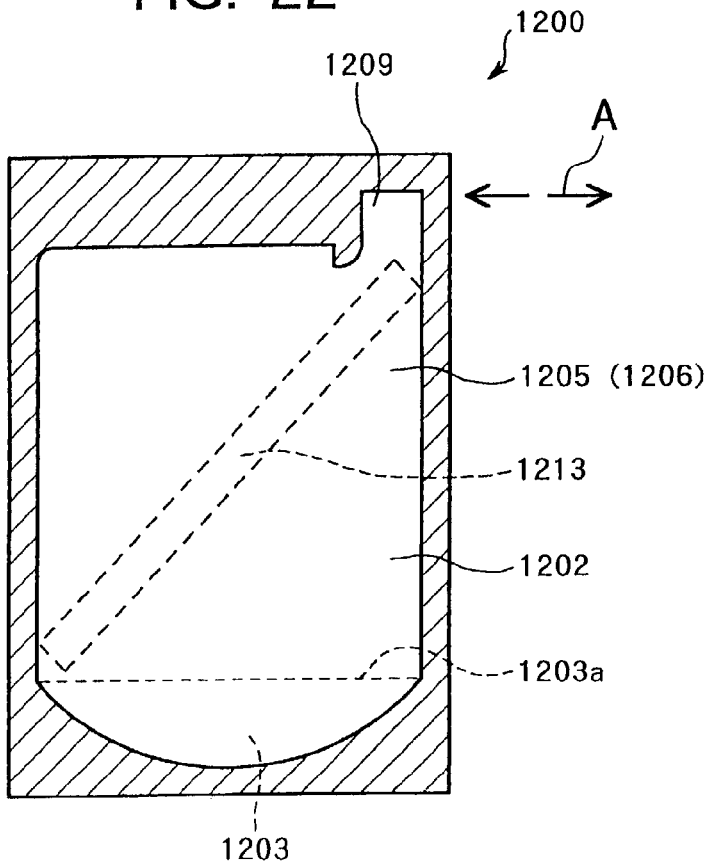
FIG. 22 is a front view showing a conventional beverage container before the container has been filled with beverage.

Further, as shown in FIG. 21, a partial cutout portion can be formed in the heat seal portion at the shoulder portion of the gusset portion and the front surface portion and the rear surface portion can be heat sealed directly to each other at the edge portion of the shoulder portion.

In order to improve barrier properties, the material for the front surface portion and the rear surface portion of the beverage container can be a four layer laminate film including 12-micron thick biaxial orientation polyester film, 9-micron thick aluminum foil, 15-micron thick biaxial orientation nylon film, and 100-micron thick straight-chain low-density polyethylene film. In this case, the gusset portion can be configured from a laminate film including 12-micron thick biaxial orientation polyester film, 9-micron thick aluminum foil, 15-micron thick biaxial orientation nylon film, and 70-micron thick straight-chain low-density polyethylene film.

With this configuration, the aluminum foil strongly blocks moisture, oxygen, and light, thereby improving barrier properties.

The front surface portion and the rear surface portion can be configured from a three layer laminate film including 12-micron thick biaxial orientation polyester film, a 12-micron thick biaxial orientation polyester film deposited with silicon dioxide (a transparent film applied by deposition processes), and a 120-micron thick straight-chain low-density polyethylene film. In this case, the gusset portion can be configured from a three-layer laminate film made from 12-micron thick biaxial orientation polyester film, a 12-micron thick biaxial orientation polyester film deposited with silicon dioxide (a transparent film applied by deposition processes), and a 80-micron thick straight-chain low-density polyethylene film. With this configuration, the transparent film applied by deposition processes can serve as a barrier layer to improve barrier properties. With this type of material, the front surface portion and the rear surface portion can be configured from a transparent material so that the position of the straw disposed in the main body portion can be confirmed externally.

Further, in the sixth through twelfth embodiments, the tearing direction instruction portion 15 can be omitted as needed because the perforations make tearing easy.

Industrial Applicability

The beverage container of the present invention is mainly used as a portable beverage container.

What is claimed is:

1. A beverage container having a main body portion and a drinking straw, the main body portion holding a beverage, the drinking straw being sealed in the main body portion with the beverage, the improvement comprising:

the main body portion being configured from a front surface portion, a rear surface portion having the same shape as the front surface portion, a bottom portion, and a pair of gusset portions, the gusset portions configuring side portions of the main body portion and sealed to edge portions of the front surface portion, the rear surface portion, and the base portion, the gusset portions each having a V-shape in cross-section to provide a bent portion before the beverage is sealed in the container, deformation of the gusset portions moving the front surface portion and the rear surface portion away from each other so that the beverage can be filled into the main body portion;

the front surface portion and the rear surface portion having upper portions configuring a neck portion formed in a shape more slender than a remainder of the front surface portion and the rear surface portion, the neck portion extending in a vertical direction;

the straw extending in the direction from the base portion toward the neck portion, the straw having an upper portion capable of being disposed within the neck portion;

a notch for starting a tear being formed on an edge portion of a seal portion in the neck portion to serve as a tear position instruction portion indicating a tear position, the front surface portion and the rear surface portion being sealed directly together without existence of the gusset portions at least at a predetermined region corresponding to the notch; and a tear direction instruction portion being provided on least one of the front surface portion, the rear surface portion, and the gusset portions, the tear direction instruction portion instructing consumers to grasp both sides of the notch and to pull in the direction and opposite the direction to make a tear, the neck portion being capable of being opened from the notch and over the upper portion of the straw, wherein the cross section of the bent portions are substantially constant along their lengths.

2. The beverage container as claimed in claim 1, wherein the upper portion of the front surface portion and the upper portion of the rear surface portion of the main body portion are in a more slender shape than the remainder of the front surface portion and the rear surface portion to constitute the neck portion extending in a vertical direction, the entire slender portion being the predetermined region where confronting edge portions are directly sealed together without the gusset portions being interposed therebetween, a distance between the edge portions of the neck portion being the same or smaller than a distance between bent lines of the bent portion of the gusset portions.

3. The beverage container as claimed in claim 1 or 2, wherein the tear direction instruction portion is configured by directly printing the tear direction on one of the front surface portion, the rear surface portion, and the gusset portions.

4. The beverage container as claimed in claim 1 or 2, wherein the tear direction instruction portion comprises a label or a seal that indicates the tear direction, the label or seal being attached or stuck on the one of the front surface portion, the rear surface portion, and the gusset portions.

5. The beverage container as claimed in claim 1 or 2, wherein the front surface portion and the rear surface portion are made from laminate sheets, at least one of the front surface portion and the rear surface portion being formed with perforations formed through all but at least one layer of the laminate sheet across the entire width of the neck portion at a position corresponding to the notch.

6. The beverage container as claimed in claim 1 or 2, wherein the straw is fixed to the neck portion or near the neck portion.

7. The beverage container as claimed in claim 6, wherein a region of the predetermined region that corresponds to the notch and where the front surface portion and the rear surface portion are directly sealed together extends to an outer peripheral surface of the upper portion of the straw positioned within the neck portion in order to support the straw in a position with respect to the main body portion.

8. The beverage container as claimed in claim 6, wherein an upper portion of the straw positioned within the neck portion is sealed to at least one of the front surface portion and the rear surface portion at a position lower than the notch portion in order to support the straw in a position with respect to the main body portion.

9. The beverage container as claimed in claim 1 or 2, wherein the straw is provided with a protrusion portion engageable with the inner periphery of the neck portion in order to prevent the straw from being pulled out from the main body portion.

10. The beverage container as claimed in claim 1, wherein the bent portions of the pair of gusset portions are positioned mutually symmetrical with respect to and in parallel with a lengthwise center line of the main body portion and configured to support the straw between the bent portions when the beverage container is in a folded, unfilled condition.

11. The beverage container as claimed in claim 1, wherein the front surface portion and the rear surface portion are configured from a transparent or opaque resin material.

12. The beverage container as claimed in claim 2, wherein the bent portions of the pair of gusset portions are, in the condition before being filled with beverage, positioned mutually symmetrical with respect to and in parallel with a lengthwise center line of the main body portion, the straw being supported between the bent portions.

13. The beverage container as claimed in claim 5, wherein the bent portions of the pair of gusset portions are, in the condition before being filled with beverage, positioned mutually symmetrical with respect to and in parallel with a lengthwise center line of the main body portion, the straw being supported between the bent portions.

14. The beverage container as claimed in claim 6, wherein the bent portions of the pair of gusset portions are, in the condition before being filled with beverage, positioned mutually symmetrical with respect to and in parallel with a lengthwise center line of the main body portion, the straw being supported between the bent portions.

15. The beverage container as claimed in claim 2, wherein the front surface portion and the rear surface portion are configured from a transparent or opaque resin material.

16. The beverage container as claimed in claim 5, wherein the front surface portion and the rear surface portion are configured from a transparent or opaque resin material.

17. The beverage container as claimed in claim 6, wherein the front surface portion and the rear surface portion are configured from a transparent or opaque resin material.

18. A beverage container having a main body portion and a drinking straw, the main body portion holding a beverage, the drinking straw being sealed in the main body portion with the beverage, the improvement comprising:

the main body portion being configured from a front surface portion, a rear surface portion having the same shape as the front surface portion, a bottom portion, and a pair of gusset portions, the gusset portions configuring side portions of the main body portion and sealed to edge portions of the front surface portion, the rear surface portion, and the base portion, the gusset portions each having a V-shape in cross-section to provide a bent portion before the beverage is sealed in the container, deformation of the gusset portions moving the front surface portion and the rear surface portion away from each other so that the beverage can be filled into the main body portion;

an upper portion of the front surface portion and an upper portion of the rear surface portion of the main body portion constituting a neck portion formed in a shape more slender than a remainder of the front surface portion and the rear surface portion and extending in a vertical direction, the gusset portions also configuring a side portion of the neck portion, the neck portion functioning as an upper pouring spout by tear-opening the neck portion;

an upper portion of the straw being positioned extending into the neck portion;

a tear position instruction portion indicating a tear position on the neck being provided on an edge portion of a seal portion in the neck portion, the front surface portion and the rear surface portion being sealed directly together without existence of the gusset portions only at a predetermined region corresponding to the tear position instruction portion; and the front surface portion and the rear surface portion being made from laminate sheets, at least one of the front surface portion and the rear surface portion being formed with perforations formed through all but at least one layer of the laminate sheet across the entire width of the neck portion at a position corresponding to the tear direction instruction portion, the neck portion being capable of being opened along the perforations and over the upper portion of the straw, wherein the cross section of the bent portions are substantially constant along their lengths.

19. A beverage container having a main body portion and a drinking straw, the main body portion holding a beverage, the drinking straw being sealed in the main body portion with the beverage, and the improvement comprising:

the main body portion being configured from a front surface portion, a rear surface portion having the same shape as the front surface portion, a bottom portion, and a pair of gusset portions, the gusset portions configuring side portions of the main body portion and sealed to edge portions of the front surface portion, the rear surface portion, and the base portion, the gusset portions each having a V-shape in cross-section to provide a bent portion before the beverage is sealed in the container, deformation of the gusset portions moving the front surface portion and the rear surface portion away from each other so that the beverage can be filled into the main body portion;

an upper portion of the front surface portion and an upper portion of the rear surface portion of the main body portion including a neck portion formed in a shape more slender than a remainder of the front surface portion and the rear surface portion and extending in a vertical direction, confronting edges of the slender front surface portion and the slender rear surface portion being sealed together, a distance between the edge portions of the neck portion being the same or smaller than a distance between bent lines of the bent portions of the gusset portions;

the upper portion of the neck portion forming a upper pouring spout opened by tearing;

a tear position instruction portion indicating a tear position on the neck being provided on an edge portion of a seal portion in the neck portion;

the front surface portion and the rear surface portion being made from laminate sheets, and at least one of the front surface portion and the rear surface portion being formed with perforations formed through all but at least one layer of the laminate sheet across the entire width of the neck portion at a position corresponding to the tear direction instruction portion;

the upper portion of the straw extending to a position in the neck portion above the position of the perforations;

a positioning means for maintaining a position of the straw with respect to the main body portion, the positioning means being provided by partially widened seal projecting toward the upper portion of the straw in the neck portion, the neck portion being capable of being opened following the perforations from the tear instruction portion and over the upper portion of the straw.

* * * * *